US009384741B2

(12) United States Patent
Morrell et al.

(10) Patent No.: US 9,384,741 B2
(45) Date of Patent: Jul. 5, 2016

(54) BINAURALIZATION OF ROTATED HIGHER ORDER AMBISONICS

(71) Applicant: QUALCOMM Incorporated, San Diego, CA (US)

(72) Inventors: Martin James Morrell, San Diego, CA (US); Dipanjan Sen, San Diego, CA (US); Nils Günther Peters, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 197 days.

(21) Appl. No.: 14/289,602

(22) Filed: May 28, 2014

(65) Prior Publication Data

US 2014/0355766 A1 Dec. 4, 2014

Related U.S. Application Data

(60) Provisional application No. 61/828,313, filed on May 29, 2013.

(51) Int. Cl.

| | |
|---|---|
| ***H04R 5/00*** | (2006.01) |
| ***G10L 19/008*** | (2013.01) |
| ***H04S 7/00*** | (2006.01) |

(52) U.S. Cl.

CPC ..... *G10L 19/008* (2013.01); *H04S 7/30* (2013.01); *H04S 7/304* (2013.01); *H04S 2400/01* (2013.01); *H04S 2420/01* (2013.01); *H04S 2420/11* (2013.01)

(58) Field of Classification Search

None

See application file for complete search history.

(56) References Cited

U.S. PATENT DOCUMENTS

2014/0249827 A1* 9/2014 Sen ..... G10L 19/167 704/500
2014/0355794 A1* 12/2014 Morrell ..... H04S 7/305 381/303
2014/0355796 A1* 12/2014 Xiang ..... H04S 7/308 381/303

FOREIGN PATENT DOCUMENTS

WO 2009046223 A2 4/2009

OTHER PUBLICATIONS

Boehm J, "Scene Based Audio Technology; An Overview", 100. MPEG Meeting; Apr. 30, 2012-May 4, 2012; Geneva; (Motion Picture Expert Group or ISO/IEC JTC1/SC29NVG11),, No. m24888, Jun. 7, 2012, 11 pages, XP030053231.

Response to Written Opinion dated Jan. 26, 2015, from International Application No. PCT/US2014/040021, filed on Apr. 24, 2015, 22 pp.

Second Written Opinion dated Jul. 16, 2015, from International Application No. PCT/US2014/040021, 19 pp.

Response to Second Written Opinion dated Jul. 16, 2015, from International Application No. PCT/US2014/040021, filed on Sep. 15, 2015, 20 pp.

(Continued)

*Primary Examiner* — Regina N Holder

(74) *Attorney, Agent, or Firm* — Shumaker & Sieffert, P.A.

(57) ABSTRACT

A device comprising one or more processors is configured to obtain transformation information, the transformation information describing how a sound field was transformed to reduce a number of a plurality of hierarchical elements to a reduced plurality of hierarchical elements; and perform binaural audio rendering with respect to the reduced plurality of hierarchical elements based on the transformation information.

30 Claims, 18 Drawing Sheets

(56) References Cited

OTHER PUBLICATIONS

"Information technology-Generic coding of moving pictures and associated audio information—Part 7: Advanced Audio Coding (AAC)," (MPEG)-2 Part 7 International Standard ISO/IEC 13818-7, Fourth Edition (Jan. 15, 2006), 202 pages.
Gerald et al., "Advanced system options for binaural rendering of Ambisonic format," 2013 IEEE International Conference on Acoustics, Speech and Signal Processing (ICASSP); Vancoucer, BC; May 26-31, 2013, Institute of Electrical and Electronics Engineers, 5 pp.
International Search Report and Written Opinion from International Application No. PCT/US2014/040021 dated Jan. 26, 2015, 15 pp.
Zotter et al., "Energy-Preserving Ambisonic Decoding," Acta Acustica United With Acustica, European Acoustics Association, Stuttgart : Hirzel, vol. 98, No. 1, Jan. 2012, pp. 37-47.
Stewart, "Spatial Auditory Display for Acoustics and Music Collections," School of Electronic Engineering and Computer Science, University of London Dissertation, Jul. 2010, 185 pp.
Wiggins, "The analysis of multi-channel sound reproduction algorithms using HRTF data," Signal Processing Research Group, University of Derby, Jun. 2001, 13 pp.
Hellerud et al., "Encoding higher order ambisonics with AAC," 124th Audio Engineering Society Convention, retrieved from http://ro.uow.edu.au/engpapers/5094, May 17-20, 2008, 9 pp.
Poletti, "Three-Dimensional Surround Sound Systems Based on Spherical Harmonics," J. Audio Eng. Soc., vol. 53, No. 11, Nov. 2005, pp. 1004-1025.
"Draft Call for Proposals for 3D Audio," International Organisation for Standardisation Organisation Internationale De Normalisation ISO/IEC JTC1/SC29/WG11 Coding of Moving Pictures and Audio, ISO/IEC JTC1/SC29/WG11/m27370, Jan. 2013, 16 pp.
"Call for Proposals for 3D Audio," International Organization for Standardization/ International Electrotechnical Commission (ISO)/(IEC) JTC1/SC29/WG11/N13411, Jan. 2013, 20 pp.
Pulkki, "Spatial Sound Reproduction with Directional Audio Coding," J. Audio Eng. Soc., vol. 55, No. 6, Jun. 2007, 14 pp.

* cited by examiner

BINAURALIZATION OF ROTATED HIGHER ORDER AMBISONICS

PRIORITY CLAIM

This application claims the benefit of U.S. Provisional Application No. 61/828,313, filed May 29, 2013.

TECHNICAL FIELD

This disclosure relates to audio rendering and, more specifically, binaural rendering of audio data.

SUMMARY

In general, techniques are described for binaural audio rendering of rotated higher order ambisonics (HOA).

As one example, a method of binaural audio rendering comprises obtaining transformation information, the transformation information describing how a sound field was transformed to reduce a number of a plurality of hierarchical elements to a reduced plurality of hierarchical elements; and performing the binaural audio rendering with respect to the reduced plurality of hierarchical elements based on the transformation information.

In another example, a device comprises one or more processors configured to obtain transformation information, the transformation information describing how a sound field was transformed to reduce a number of a plurality of hierarchical elements to a reduced plurality of hierarchical elements; and perform binaural audio rendering with respect to the reduced plurality of hierarchical elements based on the transformation information.

In another example, an apparatus comprises means for obtaining transformation information, the transformation information describing how a sound field was transformed to reduce a number of a plurality of hierarchical elements to a reduced plurality of hierarchical elements; and means for performing the binaural audio rendering with respect to the reduced plurality of hierarchical elements based on the transformation information.

In another example, a non-transitory computer-readable storage medium comprises instructions stored thereon that, when executed, configure one or more processors to obtain transformation information, the transformation information describing how a sound field was transformed to reduce a number of a plurality of hierarchical elements to a reduced plurality of hierarchical elements; and perform the binaural audio rendering with respect to the reduced plurality of hierarchical elements based on the transformation information.

The details of one or more aspects of the techniques are set forth in the accompanying drawings and the description below. Other features, objects, and advantages of these techniques will be apparent from the description and drawings, and from the claims.

BRIEF DESCRIPTION OF THE DRAWINGS

Like reference characters denote like elements throughout the figures and text.

DETAILED DESCRIPTION

Figure 1:
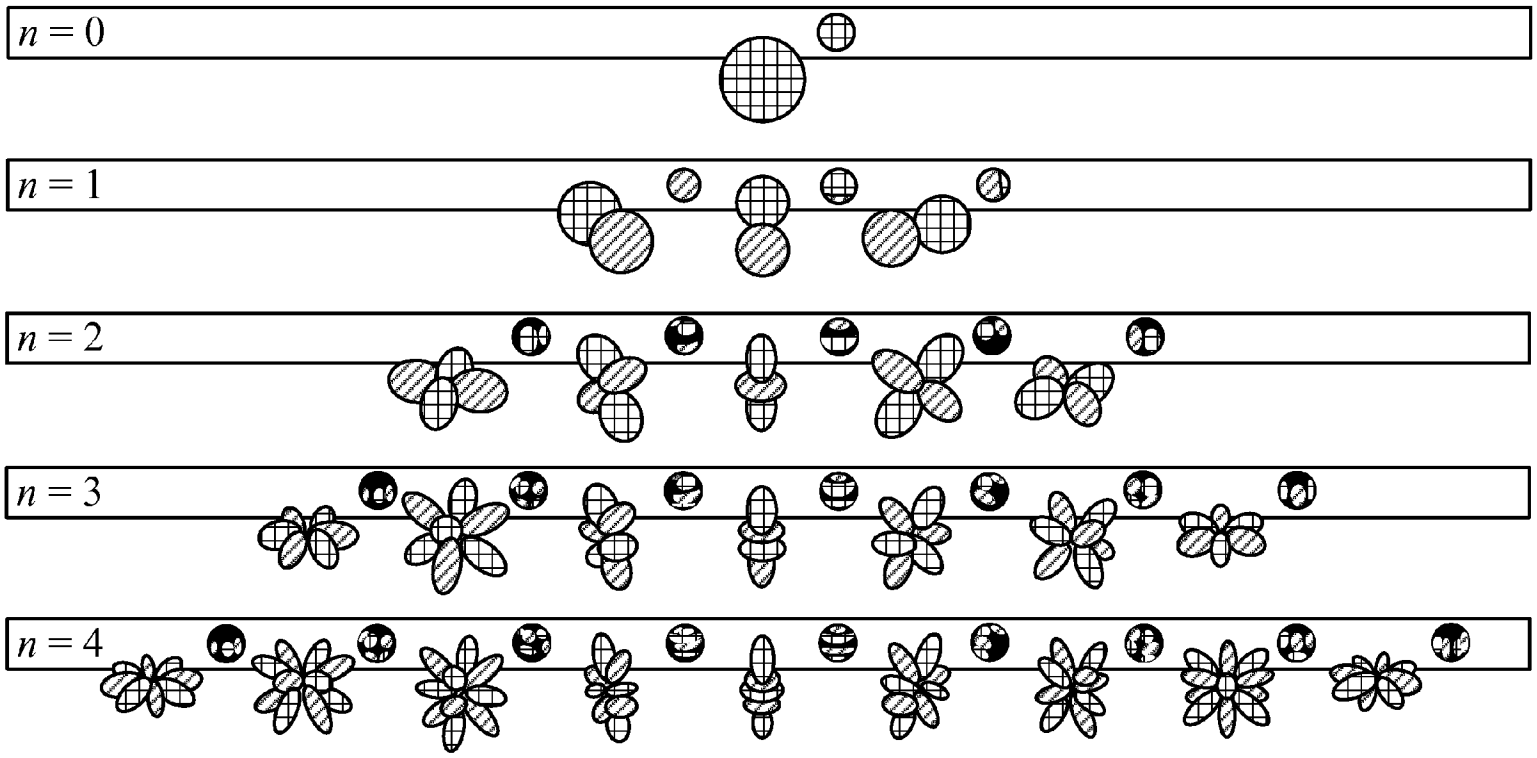
FIGS. 1 and 2 are diagrams illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. These include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on co-ordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher Order Ambisonics" or HOA, and "HOA coefficients"). This future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

This expression shows that the pressure $p_i$ at any point $\{r_r,\theta_r,\phi_r\}$ of the soundfield, at time t, can be represented uniquely by the SHC, $A_n^m(k)$. Here, $$k = \frac{\omega}{c},$$

c is the speed of sound (~343 m/s), $\{r_r,\theta_r,\phi_r\}$ is a point of reference (or observation point), $j_n(\bullet)$ is the spherical Bessel function of order n, and $Y_n^m(\theta_r,\phi_r)$ are the spherical harmonic basis functions of order n and suborder m. It can be recognized that the term in square brackets is a frequency-domain representation of the signal (i.e., $S(\omega,r_r,\theta_r,\phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

Figure 2:
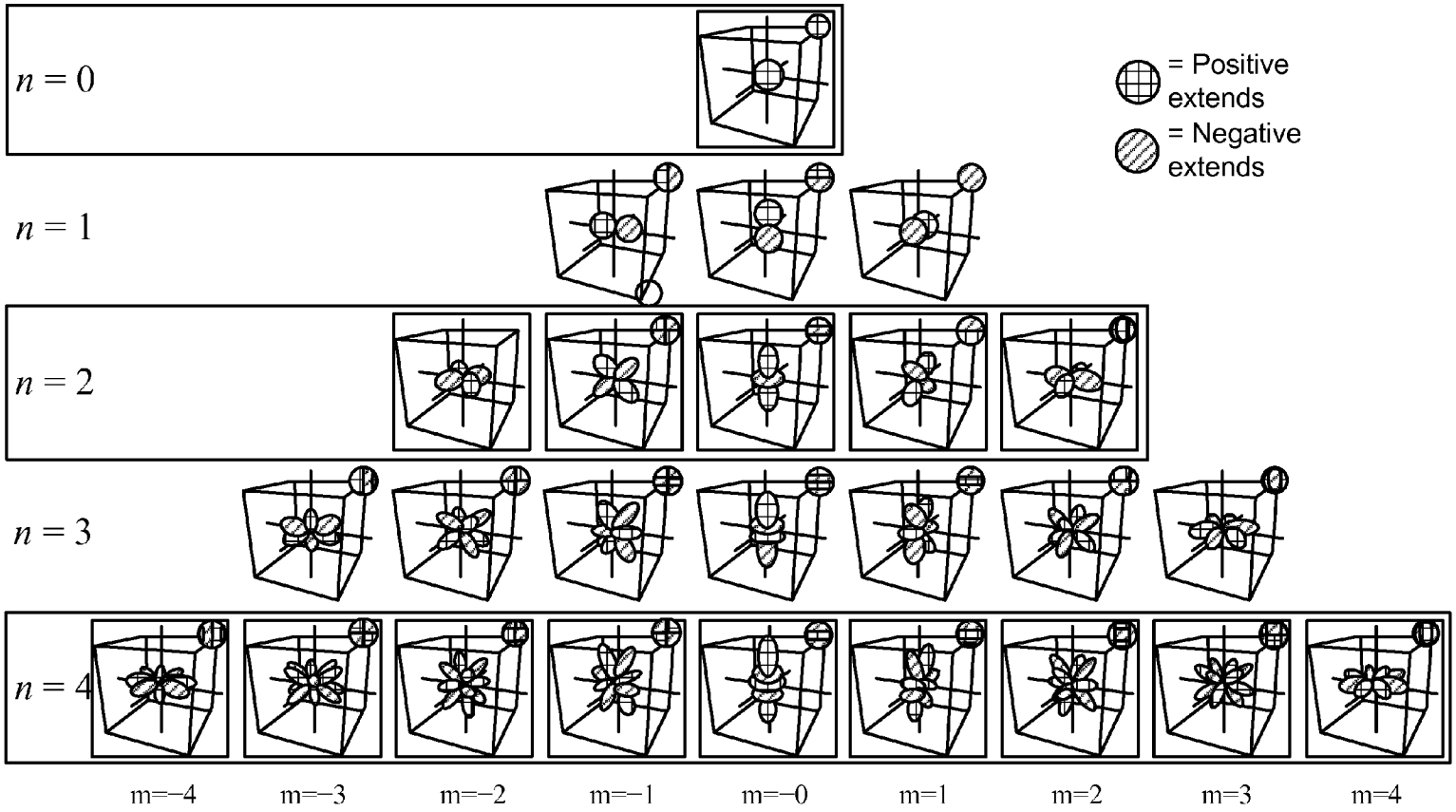

FIG. 2 is another diagram illustrating spherical harmonic basis functions from the zero order (n=0) to the fourth order (n=4). In FIG. 2, the spherical harmonic basis functions are shown in three-dimensional coordinate space with both the order and the suborder shown.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp 1004-1025.

To illustrate how these SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\phi_s),$$

where i is, $\sqrt{-1}$, $h_n^{(2)}(\bullet)$ is the spherical Hankel function (of the second kind) of order n, and $\{r_s,\theta_s,\phi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the soundfield (the pressure as a function of 3D coordinates), and the above represents the transformation from individual objects to a representation of the overall soundfield, in the vicinity of the observation point $\{r_r,\theta_r,\phi_r\}$. The remaining figures are described below in the context of object-based and SHC-based audio coding.

Figure 3:
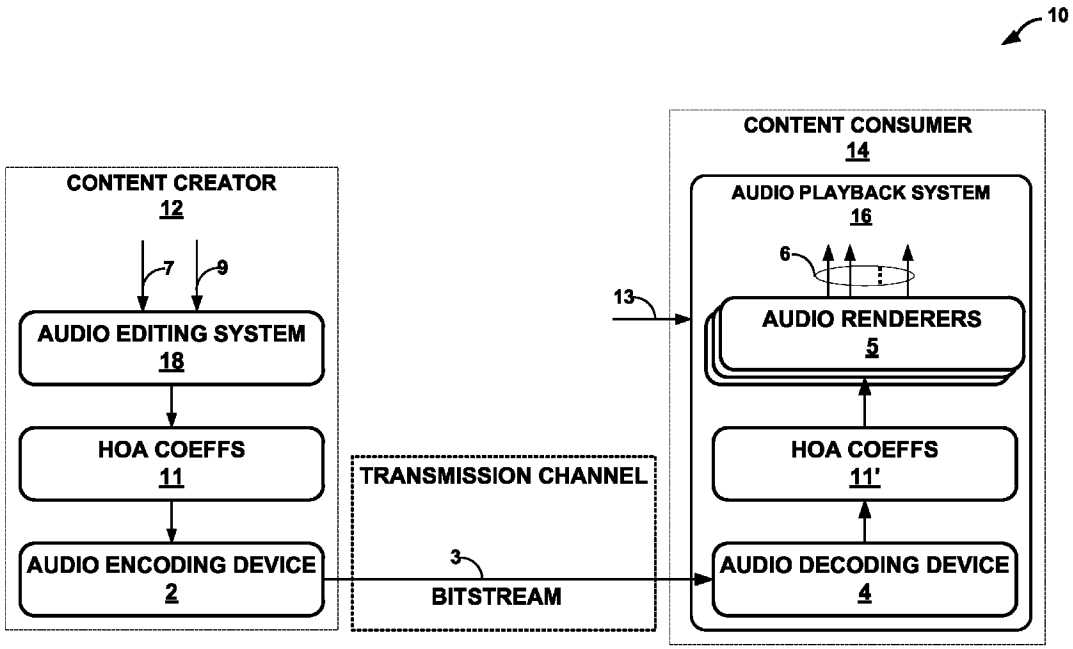
FIG. 3 is a diagram illustrating a system that may implement various aspects of the techniques described in this disclosure.

FIG. 3 is a diagram illustrating a system 10 that may perform various aspects of the techniques described in this disclosure. As shown in the example of FIG. 3, the system 10 includes a content creator 12 and a content consumer 14. While described in the context of the content creator 12 and the content consumer 14, the techniques may be implemented in any context in which SHCs (which may also be referred to as HOA coefficients) or any other hierarchical representation of a soundfield are encoded to form a bitstream representative of the audio data. Moreover, the content creator 12 may represent any form of computing device capable of implementing the techniques described in this disclosure, including a handset (or cellular phone), a tablet computer, a smart phone, or a desktop computer to provide a few examples. Likewise, the content consumer 14 may represent any form of computing device capable of implementing the techniques described in this disclosure, including a handset (or cellular phone), a tablet computer, a smart phone, a set-top box, or a desktop computer to provide a few examples.

The content creator 12 may represent a movie studio or other entity that may generate multi-channel audio content for consumption by content consumers, such as the content consumer 14. In some examples, the content creator 12 may represent an individual user who would like to compress HOA coefficients 11. Often, this content creator generates audio content in conjunction with video content. The content consumer 14 represents an individual that owns or has access to an audio playback system, which may refer to any form of audio playback system capable of rendering SHC for play back as multi-channel audio content. In the example of FIG. 3, the content consumer 14 includes an audio playback system 16.

The content creator 12 includes an audio editing system 18. The content creator 12 obtain live recordings 7 in various formats (including directly as HOA coefficients) and audio objects 9, which the content creator 12 may edit using audio editing system 18. The content creator may, during the editing process, render HOA coefficients 11 from audio objects 9, listening to the rendered speaker feeds in an attempt to identify various aspects of the soundfield that require further editing. The content creator 12 may then edit HOA coefficients 11 (potentially indirectly through manipulation of different ones of the audio objects 9 from which the source HOA coefficients may be derived in the manner described above). The content creator 12 may employ the audio editing system 18 to generate the HOA coefficients 11. The audio editing system 18 represents any system capable of editing audio data and outputting this audio data as one or more source spherical harmonic coefficients.

When the editing process is complete, the content creator 12 may generate a bitstream 3 based on the HOA coefficients 11. That is, the content creator 12 includes an audio encoding device 2 that represents a device configured to encode or otherwise compress HOA coefficients 11 in accordance with various aspects of the techniques described in this disclosure to generate the bitstream 3. The audio encoding device 2 may generate the bitstream 3 for transmission, as one example, across a transmission channel, which may be a wired or wireless channel, a data storage device, or the like. The bitstream 3 may represent an encoded version of the HOA coefficients 11 and may include a primary bitstream and another side bitstream, which may be referred to as side channel information.

Although described in more detail below, the audio encoding device 2 may be configured to encode the HOA coefficients 11 based on a vector-based synthesis or a directional-based synthesis. To determine whether to perform the vector-based synthesis methodology or a directional-based synthesis methodology, the audio encoding device 2 may determine, based at least in part on the HOA coefficients 11, whether the HOA coefficients 11 were generated via a natural recording of a soundfield (e.g., live recording 7) or produced artificially (i.e., synthetically) from, as one example, audio objects 9, such as a PCM object. When the HOA coefficients 11 were generated form the audio objects 9, the audio encoding device 2 may encode the HOA coefficients 11 using the directional-based synthesis methodology. When the HOA coefficients 11 were captured live using, for example, an eigenmike, the audio encoding device 2 may encode the HOA coefficients 11 based on the vector-based synthesis methodology. The above distinction represents one example of where vector-based or directional-based synthesis methodology may be deployed. There may be other cases where either or both may be useful for natural recordings, artificially generated content or a mixture of the two (hybrid content). Furthermore, it is also possible to use both methodologies simultaneously for coding a single time-frame of HOA coefficients.

Assuming for purposes of illustration that the audio encoding device 2 determines that the HOA coefficients 11 were captured live or otherwise represent live recordings, such as the live recording 7, the audio encoding device 2 may be configured to encode the HOA coefficients 11 using a vector-based synthesis methodology involving application of a linear invertible transform (LIT). One example of the linear invertible transform is referred to as a "singular value decomposition" (or "SVD"). In this example, the audio encoding device 2 may apply SVD to the HOA coefficients 11 to determine a decomposed version of the HOA coefficients 11. The audio encoding device 2 may then analyze the decomposed version of the HOA coefficients 11 to identify various parameters, which may facilitate reordering of the decomposed version of the HOA coefficients 11. The audio encoding device 2 may then reorder the decomposed version of the HOA coefficients 11 based on the identified parameters, where such reordering, as described in further detail below, may improve coding efficiency given that the transformation may reorder the HOA coefficients across frames of the HOA coefficients (where a frame commonly includes M samples of the HOA coefficients 11 and M is, in some examples, set to 1024). After reordering the decomposed version of the HOA coefficients 11, the audio encoding device 2 may select those of the decomposed version of the HOA coefficients 11 representative of foreground (or, in other words, distinct, predominant or salient) components of the soundfield. The audio encoding device 2 may specify the decomposed version of the HOA coefficients 11 representative of the foreground components as an audio object and associated directional information.

The audio encoding device 2 may also perform a soundfield analysis with respect to the HOA coefficients 11 in order, at least in part, to identify those of the HOA coefficients 11 representative of one or more background (or, in other words, ambient) components of the soundfield. The audio encoding device 2 may perform energy compensation with respect to the background components given that, in some examples, the background components may only include a subset of any given sample of the HOA coefficients 11 (e.g., such as those corresponding to zero and first order spherical basis functions and not those corresponding to second or higher order spherical basis functions). When order-reduction is performed, in other words, the audio encoding device 2 may augment (e.g., add/subtract energy to/from) the remaining background HOA coefficients of the HOA coefficients 11 to compensate for the change in overall energy that results from performing the order reduction.

The audio encoding device 2 may next perform a form of psychoacoustic encoding (such as MPEG surround, MPEG-AAC, MPEG-USAC or other known forms of psychoacoustic encoding) with respect to each of the HOA coefficients 11 representative of background components and each of the foreground audio objects. The audio encoding device 2 may perform a form of interpolation with respect to the foreground directional information and then perform an order reduction with respect to the interpolated foreground directional information to generate order reduced foreground directional information. The audio encoding device 2 may further perform, in some examples, a quantization with respect to the order reduced foreground directional information, outputting coded foreground directional information. In some instances, this quantization may comprise a scalar/entropy quantization. The audio encoding device 2 may then form the bitstream 3 to include the encoded background components, the encoded foreground audio objects, and the quantized directional information. The audio encoding device 2 may then transmit or otherwise output the bitstream 3 to the content consumer 14.

While shown in FIG. 3 as being directly transmitted to the content consumer 14, the content creator 12 may output the bitstream 3 to an intermediate device positioned between the content creator 12 and the content consumer 14. This intermediate device may store the bitstream 3 for later delivery to the content consumer 14, which may request this bitstream. The intermediate device may comprise a file server, a web server, a desktop computer, a laptop computer, a tablet computer, a mobile phone, a smart phone, or any other device capable of storing the bitstream 3 for later retrieval by an audio decoder. This intermediate device may reside in a content delivery network capable of streaming the bitstream 3 (and possibly in conjunction with transmitting a corresponding video data bitstream) to subscribers, such as the content consumer 14, requesting the bitstream 3.

Alternatively, the content creator 12 may store the bitstream 3 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 3.

As further shown in the example of FIG. 3, the content consumer 14 includes the audio playback system 16. The audio playback system 16 may represent any audio playback system capable of playing back multi-channel audio data. The audio playback system 16 may include a number of different renderers 5. The renderers 5 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 4. The audio decoding device 4 may represent a device configured to decode HOA coefficients 11' from the bitstream 3, where the HOA coefficients 11' may be similar to the HOA coefficients 11 but differ due to lossy operations (e.g., quantization) and/or transmission via the transmission channel. That is, the audio decoding device 4 may dequantize the foreground directional information specified in the bitstream 3, while also performing psychoacoustic decoding with respect to the foreground audio objects specified in the bitstream 3 and the encoded HOA coefficients representative of background components. The audio decoding device 4 may further perform interpolation with respect to the decoded foreground directional information and then determine the HOA coefficients representative of the foreground components based on the decoded foreground audio objects and the interpolated foreground directional information. The audio decoding device 4 may then determine the HOA coefficients 11' based on the determined HOA coefficients representative of the foreground components and the decoded HOA coefficients representative of the background components.

The audio playback system 16 may, after decoding the bitstream 3 to obtain the HOA coefficients 11' and render the HOA coefficients 11' to output loudspeaker feeds 6. The loudspeaker feeds 6 may drive one or more loudspeakers (which are not shown in the example of FIG. 3 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 16.

The audio playback system 16 may then select one of the audio renderers 5 based on the loudspeaker information 13. In some instances, the audio playback system 16 may, when none of the audio renderers 5 are within some threshold similarity measure (loudspeaker geometry wise) to that specified in the loudspeaker information 13, the audio playback system 16 may generate the one of audio renderers 5 based on the loudspeaker information 13. The audio playback system 16 may, in some instances, generate the one of audio renderers 5 based on the loudspeaker information 13 without first attempting to select an existing one of the audio renderers 5.

Figure 4:
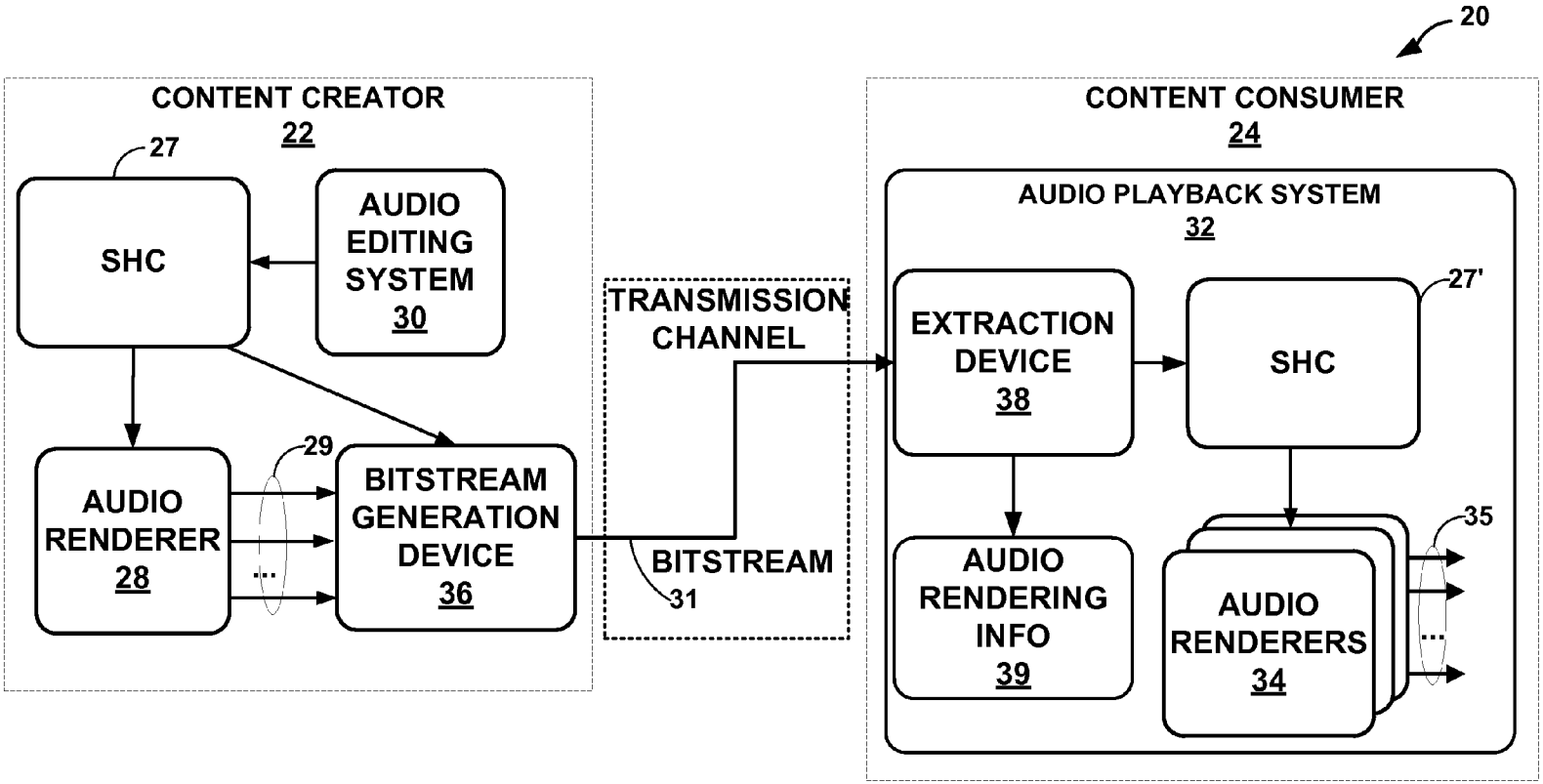
FIG. 4 is a diagram illustrating a system that may implement various aspects of the techniques described in this disclosure.

FIG. 4 is a diagram illustrating a system 20 that may perform the techniques described in this disclosure to potentially represent more efficiently audio signal information in a bitstream of audio data. As shown in the example of FIG. 3, the system 20 includes a content creator 22 and a content consumer 24. While described in the context of the content creator 22 and the content consumer 24, the techniques may be implemented in any context in which SHCs or any other hierarchical representation of a sound field are encoded to form a bitstream representative of the audio data. The components 22, 24, 30, 28, 36, 31, 32, 38, 34, and 35 may represent example instances of similarly named components of FIG. 3. Moreover, SHC 27 and 27' may represent an example instance of HOA coefficients 11 and 11', respectively.

The content creator 22 may represent a movie studio or other entity that may generate multi-channel audio content for consumption by content consumers, such as the content consumer 24. Often, this content creator generates audio content in conjunction with video content. The content consumer 24 represents an individual that owns or has access to an audio playback system, which may refer to any form of audio playback system capable of playing back multi-channel audio content. In the example of FIG. 4, the content consumer 24 includes an audio playback system 32.

The content creator 22 includes an audio renderer 28 and an audio editing system 30. The audio renderer 26 may represent an audio processing unit that renders or otherwise generates speaker feeds (which may also be referred to as "loudspeaker feeds," "speaker signals," or "loudspeaker signals"). Each speaker feed may correspond to a speaker feed that reproduces sound for a particular channel of a multi-channel audio system. In the example of FIG. 4, the renderer 38 may render speaker feeds for conventional 5.1, 7.1 or 22.2 surround sound formats, generating a speaker feed for each of the 5, 7 or 22 speakers in the 5.1, 7.1 or 22.2 surround sound speaker systems. Alternatively, the renderer 28 may be configured to render speaker feeds from source spherical harmonic coefficients for any speaker configuration having any number of speakers, given the properties of source spherical harmonic coefficients discussed above. The renderer 28 may, in this manner, generate a number of speaker feeds, which are denoted in FIG. 4 as speaker feeds 29.

The content creator may, during the editing process, render spherical harmonic coefficients 27 ("SHC 27"), listening to the rendered speaker feeds in an attempt to identify aspects of the sound field that do not have high fidelity or that do not provide a convincing surround sound experience. The content creator 22 may then edit source spherical harmonic coefficients (often indirectly through manipulation of different objects from which the source spherical harmonic coefficients may be derived in the manner described above). The content creator 22 may employ the audio editing system 30 to edit the spherical harmonic coefficients 27. The audio editing system 30 represents any system capable of editing audio data and outputting this audio data as one or more source spherical harmonic coefficients.

When the editing process is complete, the content creator 22 may generate bitstream 31 based on the spherical harmonic coefficients 27. That is, the content creator 22 includes a bitstream generation device 36, which may represent any device capable of generating the bitstream 31. In some instances, the bitstream generation device 36 may represent an encoder that bandwidth compresses (through, as one example, entropy encoding) the spherical harmonic coefficients 27 and that arranges the entropy encoded version of the spherical harmonic coefficients 27 in an accepted format to form the bitstream 31. In other instances, the bitstream generation device 36 may represent an audio encoder (possibly, one that complies with a known audio coding standard, such as MPEG surround, or a derivative thereof) that encodes the multi-channel audio content 29 using, as one example, processes similar to those of conventional audio surround sound encoding processes to compress the multi-channel audio content or derivatives thereof. The compressed multi-channel audio content 29 may then be entropy encoded or coded in some other way to bandwidth compress the content 29 and arranged in accordance with an agreed upon format to form the bitstream 31. Whether directly compressed to form the bitstream 31 or rendered and then compressed to form the bitstream 31, the content creator 22 may transmit the bitstream 31 to the content consumer 24.

While shown in FIG. 4 as being directly transmitted to the content consumer 24, the content creator 22 may output the bitstream 31 to an intermediate device positioned between the content creator 22 and the content consumer 24. This intermediate device may store the bitstream 31 for later delivery to the content consumer 24, which may request this bitstream. The intermediate device may comprise a file server, a web server, a desktop computer, a laptop computer, a tablet computer, a mobile phone, a smart phone, or any other device capable of storing the bitstream 31 for later retrieval by an audio decoder. This intermediate device may reside in a content delivery network capable of streaming the bitstream 31 (and possibly in conjunction with transmitting a corresponding video data bitstream) to subscribers, such as the content consumer 24, requesting the bitstream 31. Alternatively, the content creator 22 may store the bitstream 31 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 4.

As further shown in the example of FIG. 4, the content consumer 24 includes the audio playback system 32. The audio playback system 32 may represent any audio playback system capable of playing back multi-channel audio data. The audio playback system 32 may include a number of different renderers 34. The renderers 34 may each provide for a different form of rendering, where the different forms of rendering may include one or more of the various ways of performing vector-base amplitude panning (VBAP), and/or one or more of the various ways of performing sound field synthesis.

The audio playback system 32 may further include an extraction device 38. The extraction device 38 may represent any device capable of extracting spherical harmonic coefficients 27' ("SHC 27'," which may represent a modified form of or a duplicate of spherical harmonic coefficients 27) through a process that may generally be reciprocal to that of the bitstream generation device 36. In any event, the audio playback system 32 may receive the spherical harmonic coefficients 27' and may select one of the renderers 34, which then renders the spherical harmonic coefficients 27' to generate a number of speaker feeds 35 (corresponding to the number of loudspeakers electrically or possibly wirelessly coupled to the audio playback system 32, which are not shown in the example of FIG. 4 for ease of illustration purposes).

Typically, when the bitstream generation device 36 directly encodes SHC 27, the bitstream generation device 36 encodes all of SHC 27. The number of SHC 27 sent for each representation of the sound field is dependent on the order and may be expressed mathematically as $(1+n)^2$/sample, where n again denotes the order. To achieve a fourth order representation of the sound field, as one example, 25 SHCs may be derived. Typically, each of the SHCs is expressed as a 32-bit signed floating point number. Thus, to express a fourth order representation of the sound field, a total of 25×32 or 800 bits/sample are required in this example. When a sampling rate of 48 kHz is used, this represents 38,400,000 bits/second. In some instances, one or more of the SHC 27 may not specify salient information (which may refer to information that contains audio information audible or important in describing the sound field when reproduced at the content consumer 24). Encoding these non-salient ones of the SHC 27 may result in inefficient use of bandwidth through the transmission channel (assuming a content delivery network type of transmission mechanism). In an application involving storage of these coefficients, the above may represent an inefficient use of storage space.

The bitstream generation device 36 may identify, in the bitstream 31, those of the SHC 27 that are included in the bitstream 31 and specify, in the bitstream 31, the identified ones of the SHC 27. In other words, bitstream generation device 36 may specify, in the bitstream 31, the identified ones of the SHC 27 without specifying, in the bitstream 31, any of those of the SHC 27 that are not identified as being included in the bitstream.

In some instances, when identifying those of the SHC 27 that are included in the bitstream 31, the bitstream generation device 36 may specify a field having a plurality of bits with a different one of the plurality of bits identifying whether a corresponding one of the SHC 27 is included in the bitstream 31. In some instances, when identifying those of the SHC 27 that are included in the bitstream 31, the bitstream generation device 36 may specify a field having a plurality of bits equal to $(n+1)^2$ bits, where n denotes an order of the hierarchical set of elements describing the sound field, and where each of the plurality of bits identify whether a corresponding one of the SHC 27 is included in the bitstream 31.

In some instances, the bitstream generation device 36 may, when identifying those of the SHC 27 that are included in the bitstream 31, specify a field in the bitstream 31 having a plurality of bits with a different one of the plurality of bits identifying whether a corresponding one of the SHC 27 is included in the bitstream 31. When specifying the identified ones of the SHC 27, the bitstream generation device 36 may specify, in the bitstream 31, the identified ones of the SHC 27 directly after the field having the plurality of bits.

In some instances, the bitstream generation device 36 may additionally determine that one or more of the SHC 27 has information relevant in describing the sound field. When identifying those of the SHC 27 that are included in the bitstream 31, the bitstream generation device 36 may identify that the determined one or more of the SHC 27 having information relevant in describing the sound field are included in the bitstream 31.

In some instances, the bitstream generation device 36 may additionally determine that one or more of the SHC 27 have information relevant in describing the sound field. When identifying those of the SHC 27 that are included in the bitstream 31, the bitstream generation device 36 may identify, in the bitstream 31, that the determined one or more of the SHC 27 having information relevant in describing the sound field are included in the bitstream 31, and identify, in the bitstream 31, that remaining ones of the SHC 27 having information not relevant in describing the sound field are not included in the bitstream 31.

In some instances, the bitstream generation device 36 may determine that one or more of the SHC 27 values are below a threshold value. When identifying those of the SHC 27 that are included in the bitstream 31, the bitstream generation device 36 may identify, in the bitstream 31, that the determined one or more of the SHC 27 that are above this threshold value are specified in the bitstream 31. While the threshold may often be a value of zero, for practical implementations, the threshold may be set to a value representing a noise-floor (or ambient energy) or some value proportional to the current signal energy (which may make the threshold signal dependent).

In some instances, the bitstream generation device 36 may adjust or transform the sound field to reduce a number of the SHC 27 that provide information relevant in describing the sound field. The term "adjusting" may refer to application of any matrix or matrixes that represents a linear invertible transform. In these instances, the bitstream generation device 36 may specify adjustment information (which may also be referred to as "transformation information") in the bitstream 31 describing how the sound field was adjusted. While described as specifying this information in addition to the information identifying those of the SHC 27 that are subsequently specified in the bitstream, this aspect of the techniques may be performed as an alternative to specifying information identifying those of the SHC 27 that are included in the bitstream. The techniques should therefore not be limited in this respect but may provide for a method of generating a bitstream comprised of a plurality of hierarchical elements that describe a sound field, where the method comprises adjusting the sound field to reduce a number of the plurality of hierarchical elements that provide information relevant in describing the sound field, and specifying adjustment information in the bitstream describing how the sound field was adjusted.

In some instances, the bitstream generation device 36 may rotate the sound field to reduce a number of the SHC 27 that provide information relevant in describing the sound field. In these instances, the bitstream generation device 36 may specify rotation information in the bitstream 31 describing how the sound field was rotated. Rotation information may comprise an azimuth value (capable of signaling 360 degrees) and an elevation value (capable of signaling 180 degrees). In some instances, the rotation information may comprise one or more angles specified relative to an x-axis and a y-axis, an x-axis and a z-axis and/or a y-axis and a z-axis. In some instances, the azimuth value comprises one or more bits, and typically includes 10 bits. In some instances, the elevation value comprises one or more bits and typically includes at least 9 bits. This choice of bits allows, in the simplest embodiment, a resolution of 180/512 degrees (in both elevation and azimuth). In some instances, the adjustment may comprise the rotation and the adjustment information described above includes the rotation information. In some instances, the bitstream generation device 36 may translate the sound field to reduce a number of the SHC 27 that provide information relevant in describing the sound field. In these instances, the bitstream generation device 36 may specify translation information in the bitstream 31 describing how the sound field was translated. In some instances, the adjustment may comprise the translation and the adjustment information described above includes the translation information.

In some instances, the bitstream generation device 36 may adjust the sound field to reduce a number of the SHC 27 having non-zero values above a threshold value and specify adjustment information in the bitstream 31 describing how the sound field was adjusted.

In some instances, the bitstream generation device 36 may rotate the sound field to reduce a number of the SHC 27 having non-zero values above a threshold value, and specify rotation information in the bitstream 31 describing how the sound field was rotated.

In some instances, the bitstream generation device 36 may translate the sound field to reduce a number of the SHC 27 having non-zero values above a threshold value, and specify translation information in the bitstream 31 describing how the sound field was translated.

By identifying in the bitstream 31 those of the SHC 27 that are included in the bitstream 31, this process may promote more efficient usage of bandwidth in that those of the SHC 27 that do not include information relevant to the description of the sound field (such as zero valued ones of the SCH 27) are not specified in the bitstream, i.e., not included in the bitstream. Moreover, by additionally or alternatively, adjusting the sound field when generating the SHC 27 to reduce the number of SHC 27 that specify information relevant to the description of the sound field, this process may again or additionally result in potentially more efficient bandwidth usage. Both aspects of this process may reduce the number of SHC 27 that are required to be specified in the bitstream 31, thereby potentially improving utilization of bandwidth in non-fix rate systems (which may refer to audio coding techniques that do not have a target bitrate or provide a bit-budget per frame or sample to provide a few examples) or, in fix rate system, potentially resulting in allocation of bits to information that is more relevant in describing the sound field.

Within the content consumer 24, the extraction device 38 may then process the bitstream 31 representative of audio content in accordance with aspects of the above described process that is generally reciprocal to the process described above with respect to the bitstream generation device 36. The extraction device 38 may determine, from the bitstream 31, those of the SHC 27' describing a sound field that are included in the bitstream 31, and parse the bitstream 31 to determine the identified ones of the SHC 27'.

In some instances, the extraction device 38 may when, determining those of the SHC 27' that are included in the bitstream 31, the extraction device 38 may parse the bitstream 31 to determine a field having a plurality of bits with each one of the plurality of bits identifying whether a corresponding one of the SHC 27' is included in the bitstream 31.

In some instances, the extraction device 38 may when, determining those of the SHC 27' that are included in the bitstream 31, specify a field having a plurality of bits equal to $(n+1)^2$ bits, where again n denotes an order of the hierarchical set of elements describing the sound field. Again, each of the plurality of bits identify whether a corresponding one of the SHC 27' is included in the bitstream 31.

In some instances, the extraction device 38 may when, determining those of the SHC 27' that are included in the bitstream 31, parse the bitstream 31 to identify a field in the bitstream 31 having a plurality of bits with a different one of the plurality of bits identifying whether a corresponding one of the SHC 27' is included in the bitstream 31. The extraction device 38 may when, parsing the bitstream 31 to determine the identified ones of the SHC 27', parse the bitstream 31 to determine the identified ones of the SHC 27' directly from the bitstream 31 after the field having the plurality of bits.

In some instances, the extraction device 38 may, as an alternative to or in conjunction with the above described processes, parse the bitstream 31 to determine adjustment information describing how the sound field was adjusted to reduce a number of the SHC 27' that provide information relevant in describing the sound field. The extraction device 38 may provide this information to the audio playback system 32, which when reproducing the sound field based on those of the SHC 27' that provide information relevant in describing the sound field, adjusts the sound field based on the adjustment information to reverse the adjustment performed to reduce the number of the plurality of hierarchical elements.

In some instances, the extraction device 38 may, as an alternative to or in conjunction with the above described processes, parse the bitstream 31 to determine rotation information describing how the sound field was rotated to reduce a number of the SHC 27' that provide information relevant in describing the sound field. The extraction device 38 may provide this information to the audio playback system 32, which when reproducing the sound field based on those of the SHC 27' that provide information relevant in describing the sound field, rotates the sound field based on the rotation information to reverse the rotation performed to reduce the number of the plurality of hierarchical elements.

In some instances, the extraction device 38 may, as an alternative to or in conjunction with the above described processes, parse the bitstream 31 to determine translation information describing how the sound field was translated to reduce a number of the SHC 27' that provide information relevant in describing the sound field. The extraction device 38 may provide this information to the audio playback system 32, which when reproducing the sound field based on those of the SHC 27' that provide information relevant in describing the sound field, translates the sound field based on the adjustment information to reverse the translation performed to reduce the number of the plurality of hierarchical elements.

In some instances, the extraction device 38 may, as an alternative to or in conjunction with the above described processes, parse the bitstream 31 to determine adjustment information describing how the sound field was adjusted to reduce a number of the SHC 27' that have non-zero values. The extraction device 38 may provide this information to the audio playback system 32, which when reproducing the sound field based on those of the SHC 27' that have non-zero values, adjusts the sound field based on the adjustment information to reverse the adjustment performed to reduce the number of the plurality of hierarchical elements.

In some instances, the extraction device 38 may, as an alternative to or in conjunction with the above described processes, parse the bitstream 31 to determine rotation information describing how the sound field was rotated to reduce a number of the SHC 27' that have non-zero values. The extraction device 38 may provide this information to the audio playback system 32, which when reproducing the sound field based on those of the SHC 27' that have non-zero values, rotating the sound field based on the rotation information to reverse the rotation performed to reduce the number of the plurality of hierarchical elements.

In some instances, the extraction device 38 may, as an alternative to or in conjunction with the above described processes, parse the bitstream 31 to determine translation information describing how the sound field was translated to reduce a number of the SHC 27' that have non-zero values. The extraction device 38 may provide this information to the audio playback system 32, which when reproducing the sound field based on those of the SHC 27' that have non-zero values, translates the sound field based on the translation information to reverse the translation performed to reduce the number of the plurality of hierarchical elements.

Figure 5A:
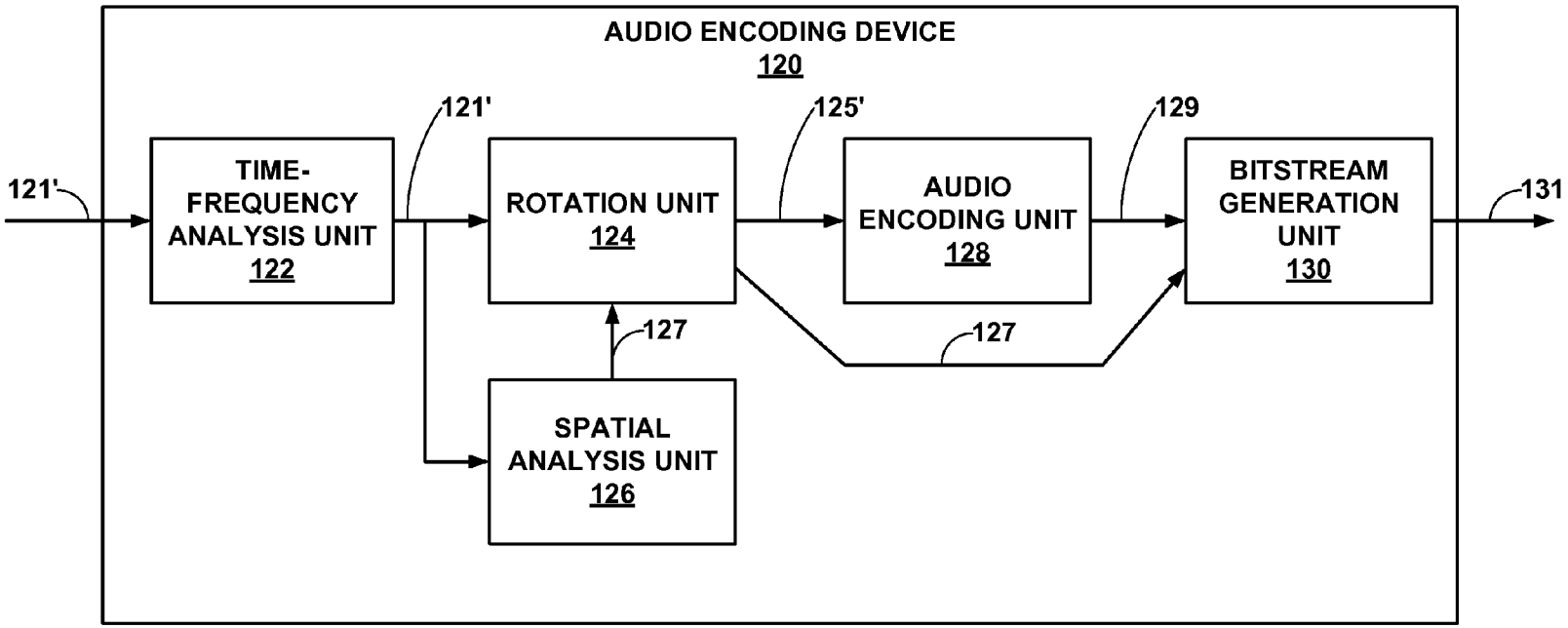
FIGS. 5A and 5B are block diagrams illustrating audio encoding devices that may implement various aspects of the techniques described in this disclosure.

FIG. 5A is a block diagram illustrating an audio encoding device 120 that may implement various aspects of the techniques described in this disclosure. While illustrated as a single device, i.e., the audio encoding device 120 in the example of FIG. 9, the techniques may be performed by one or more devices. Accordingly, the techniques should be not limited in this respect.

In the example of FIG. 5A, the audio encoding device 120 includes a time-frequency analysis unit 122, a rotation unit 124, a spatial analysis unit 126, an audio encoding unit 128 and a bitstream generation unit 130. The time-frequency analysis unit 122 may represent a unit configured to transform SHC 121 (which may also be referred to a higher order ambisonics (HOA) in that the SHC 121 may include at least one coefficient associated with an order greater than one) from the time domain to the frequency domain. The time-frequency analysis unit 122 may apply any form of Fourier-based transform, including a fast Fourier transform (FFT), a discrete cosine transform (DCT), a modified discrete cosine transform (MDCT), and a discrete sine transform (DST) to provide a few examples, to transform the SHC 121 from the time domain to the frequency domain. The transformed version of the SHC 121 are denoted as the SHC 121', which the time-frequency analysis unit 122 may output to the rotation analysis unit 124 and the spatial analysis unit 126. In some instances, the SHC 121 may already be specified in the frequency domain. In these instances, the time-frequency analysis unit 122 may pass the SHC 121' to the rotation analysis unit 124 and the spatial analysis unit 126 without applying a transform or otherwise transforming the received SHC 121.

The rotation unit 124 may represent a unit that performs the rotation aspects of the techniques described above in more detail. The rotation unit 124 may work in conjunction with the spatial analysis unit 126 to rotate (or, more generally, transform) the sound field so as to remove one or more of the SHC 121'. The spatial analysis unit 126 may represent a unit configured to perform spatial analysis in a manner similar to the "spatial compaction" algorithm described above. The spatial analysis unit 126 may output transformation information 127 (which may include an elevation angle and azimuth angle) to the rotation unit 124. The rotation unit 124 may then rotate the sound field in accordance with the transformation information 127 (which may also be referred to as "rotation information 127") and generate a reduced version of the SHC 121', which may be denoted as SHC 125' in the example of FIG. 5A. The rotation unit 124 may output the SHC 125' to the audio encoding unit 126, while outputting the transformation information 127 to the bitstream generation unit 128.

The audio encoding unit 126 may represent a unit configured to audio encode the SHC 125' to output encoded audio data 129. The audio encoding unit 126 may perform any form of audio encoding. As one example, the audio encoding unit 126 may perform advanced audio coding (AAC) in accordance with a motion pictures experts group (MPEG)-2 Part 7 standard (otherwise denoted as ISO/IEC 13818-7:1997) and/or an MPEG-4 Parts 3-5. The audio encoding unit 126 may effectively treat each order/sub-order combination of the SHC 125' as a separate channel, encoding these separate channels using a separate instance of an AAC encoder. More information regarding encoding of HOA can be found in the Audio Engineering Society Convention Paper 7366, entitled "Encoding Higher Order Ambisonics with AAC," by Eric Hellerud et al, which was presented at the 124$^{th}$ Audio Engineering Society Convention, 2008 May 17-20 in Amsterdam, Netherlands. The audio encoding unit 126 may output the encoded audio data 129 to the bitstream generation unit 130.

The bitstream generation unit 130 may represent a unit configured to generate a bitstream that conforms with some known format, which may be proprietary, freely available, standardized or the like. The bitstream generation unit 130 may multiplex the rotation information 127 with the encoded audio data 129 to generate a bitstream 131. The bitstream 131 may conform to the examples set forth in any of FIGS. 6A-6E, except that the SHC 27' may be replaced with encoded audio data 129. The bitstreams 131, 131' may each represent an example of bitstreams 3, 31.

Figure 5B:
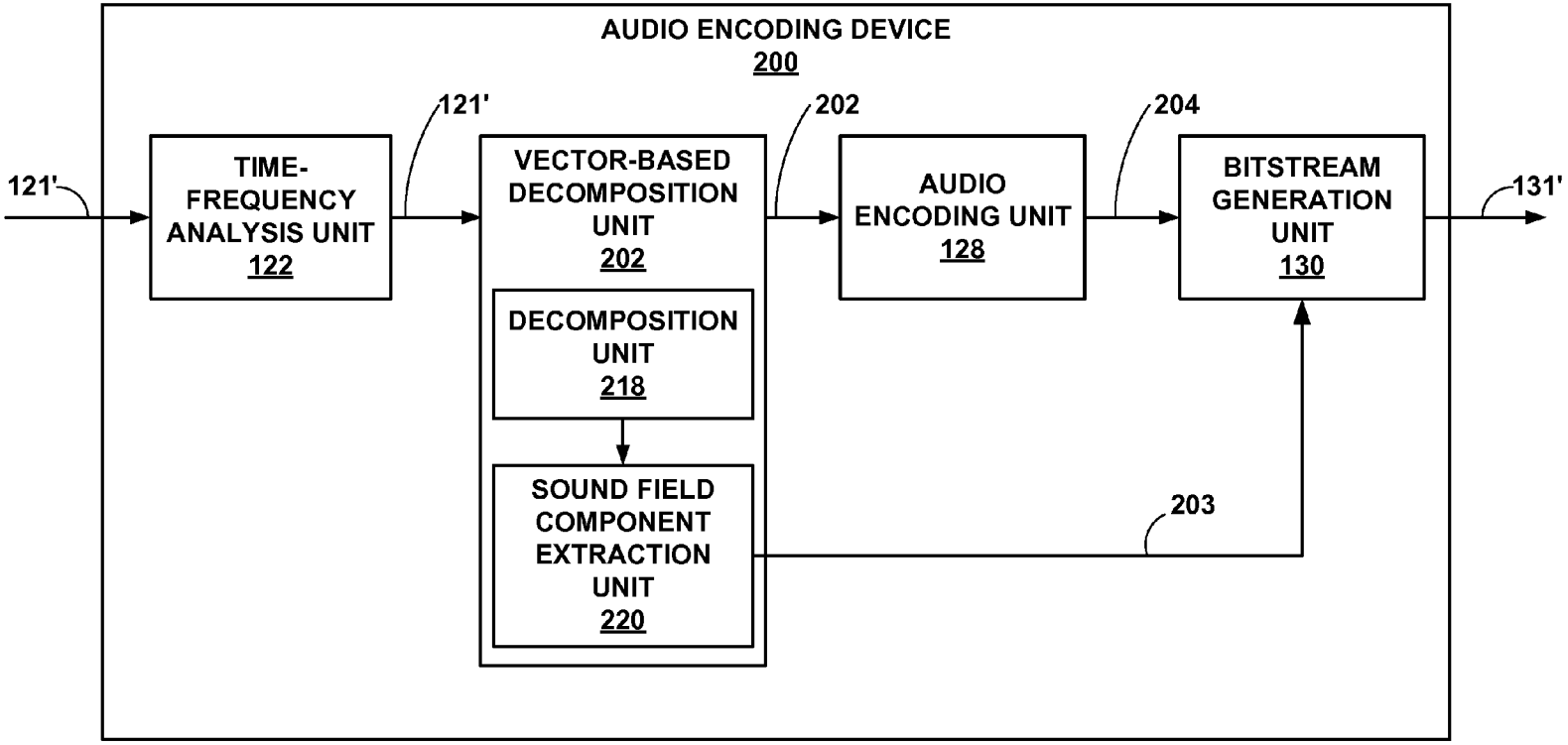

FIG. 5B is a block diagram illustrating an audio encoding device 200 that may implement various aspects of the techniques described in this disclosure. While illustrated as a single device, i.e., the audio encoding device 200 in the example of FIG. 5B, the techniques may be performed by one or more devices. Accordingly, the techniques should be not limited in this respect.

The audio encoding device 200, like the audio encoding device 120 of FIG. 5A, includes a time-frequency analysis unit 122, audio encoding unit 128, and bitstream generation unit 130. The audio encoding device 120, in lieu of obtaining and providing rotation information for the sound field in a side channel embedded in the bitstream 131', instead applies a vector-based decomposition to SHC 121' to transform the SHC 121' into transformed spherical harmonic coefficients 202, which may include a rotation matrix from which the audio encoding device 120 may extract rotation information for sound field rotation and subsequent encoding. As a result, in this example the rotation information need not be embedded in the bitstream 131', for the rendering device may perform a similar operation to obtain the rotation information from the transformed spherical harmonic coefficients encoded to bitstream 131' and de-rotate the sound field to restore the original coordinate system of the SHCs. This operation is described in further detail below.

As shown in the example of FIG. 5B, the audio encoding device 200 includes a vector-based decomposition unit 202, an audio encoding unit 128 and a bitstream generation unit 130. The vector-based decomposition unit 202 may represent a unit that compresses SHCs 121'. In some instances, the vector-based decomposition unit 202 represents a unit that may losslessly compress the SHCs 121'. The SHCs 121' may represent a plurality of SHCs, where at least one of the plurality of SHC have an order greater than one (where SHC of this variety are referred to as higher order ambisonics (HOA) so as to distinguish from lower order ambisonics of which one example is the so-called "B-format"). While the vector-based decomposition unit 202 may losslessly compress the SHCs 121', typically the vector-based decomposition unit 202 removes those of the SHCs 121' that are not salient or relevant in describing the sound field when reproduced (in that some may not be capable of being heard by the human auditory system). In this sense, the lossy nature of this compression may not overly impact the perceived quality of the sound field when reproduced from the compressed version of the SHCs 121'.

In the example of FIG. 5B, the vector-based decomposition unit 202 may include a decomposition unit 218 and a sound field component extraction unit 220. The decomposition unit 218 may represent a unit configured to perform a form of analysis referred to as singular value decomposition. While described with respect to SVD, the techniques may be performed with respect to any similar transformation or decomposition that provides for sets of linearly uncorrelated data. Also, reference to "sets" in this disclosure is generally intended to refer to "non-zero" sets unless specifically stated to the contrary and is not intended to refer to the classical mathematical definition of sets that includes the so-called "empty set."

An alternative transformation may comprise a principal component analysis, which is often abbreviated by the initialism PCA. PCA refers to a mathematical procedure that employs an orthogonal transformation to convert a set of observations of possibly correlated variables into a set of linearly uncorrelated variables referred to as principal components. Linearly uncorrelated variables represent variables that do not have a linear statistical relationship (or dependence) to one another. These principal components may be described as having a small degree of statistical correlation to one another. In any event, the number of so-called principal components is less than or equal to the number of original variables. Typically, the transformation is defined in such a way that the first principal component has the largest possible variance (or, in other words, accounts for as much of the variability in the data as possible), and each succeeding component in turn has the highest variance possible under the constraint that this successive component be orthogonal to (which may be restated as uncorrelated with) the preceding components. PCA may perform a form of order-reduction, which in terms of the SHC 11A may result in the compression of the SHC 11A. Depending on the context, PCA may be referred to by a number of different names, such as discrete Karhunen-Loeve transform, the Hotelling transform, proper orthogonal decomposition (POD), and eigenvalue decomposition (EVD) to name a few examples.

In any event, the decomposition unit 218 performs a singular value decomposition (which, again, may be denoted by its initialism "SVD") to transform the spherical harmonic coefficients 121' into two or more sets of transformed spherical harmonic coefficients. In the example of FIG. 5B, the decomposition unit 218 may perform the SVD with respect to the SHC 121' to generate a so-called V matrix, an S matrix, and a U matrix. SVD, in linear algebra, may represent a factorization of a m-by-n real or complex matrix X (where X may represent multi-channel audio data, such as the SHC 121') in the following form:

$$X=USV^*$$

U may represent an m-by-m real or complex unitary matrix, where the m columns of U are commonly known as the left-singular vectors of the multi-channel audio data. S may represent an m-by-n rectangular diagonal matrix with non-negative real numbers on the diagonal, where the diagonal values of S are commonly known as the singular values of the multi-channel audio data. V* (which may denote a conjugate transpose of V) may represent an n-by-n real or complex unitary matrix, where the n columns of V* are commonly known as the right-singular vectors of the multi-channel audio data.

While described in this disclosure as being applied to multi-channel audio data comprising spherical harmonic coefficients 121', the techniques may be applied to any form of multi-channel audio data. In this way, the audio encoding device 200 may perform a singular value decomposition with respect to multi-channel audio data representative of at least a portion of sound field to generate a U matrix representative of left-singular vectors of the multi-channel audio data, an S matrix representative of singular values of the multi-channel audio data and a V matrix representative of right-singular vectors of the multi-channel audio data, and representing the multi-channel audio data as a function of at least a portion of one or more of the U matrix, the S matrix and the V matrix.

Generally, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered equal to the V matrix. Below it is assumed, for ease of illustration purposes, that the SHC 121' comprise real-numbers with the result that the V matrix is output through SVD rather than the V* matrix. While assumed to be the V matrix, the techniques may be applied in a similar fashion to SHC 121' having complex coefficients, where the output of the SVD is the V* matrix. Accordingly, the techniques should not be limited in this respect to only providing for application of SVD to generate a V matrix, but may include application of SVD to SHC 11A having complex components to generate a V* matrix.

In any event, the decomposition unit 218 may perform a block-wise form of SVD with respect to each block (which may refer to a frame) of higher-order ambisonics (HOA) audio data (where this ambisonics audio data includes blocks or samples of the SHC 121' or any other form of multi-channel audio data). A variable M may be used to denote the length of an audio frame in samples. For example, when an audio frame includes 1024 audio samples, M equals 1024. The decomposition unit 218 may therefore perform a block-wise SVD with respect to a block the SHC 11A having M-by-$(N+1)^2$ SHC, where N, again, denotes the order of the HOA audio data. The decomposition unit 218 may generate, through performing this SVD, V matrix, S matrix 19B, and U matrix. The decomposition unit 218 may pass or output these matrixes to sound field component extraction unit 20. The V matrix 19A may be of size $(N+1)^2$-by-$(N+1)^2$, the S matrix 19B may be of size $(N+1)^2$-by-$(N+1)^2$ and the U matrix may be of size M-by-$(N+1)^2$, where M refers to the number of samples in an audio frame. A typical value for M is 1024, although the techniques of this disclosure should not be limited to this typical value for M.

The sound field component extraction unit 220 may represent a unit configured to determine and then extract distinct components of the sound field and background components of the sound field, effectively separating the distinct components of the sound field from the background components of the sound field. Given that distinct components of the sound field typically require higher order (relative to background components of the sound field) basis functions (and therefore more SHC) to accurately represent the distinct nature of these components, separating the distinct components from the background components may enable more bits to be allocated to the distinct components and less bits (relatively, speaking) to be allocated to the background components. Accordingly, through application of this transformation (in the form of SVD or any other form of transform, including PCA), the techniques described in this disclosure may facilitate the allocation of bits to various SHC, and thereby compression of the SHC 121'.

Moreover, the techniques may also enable, order reduction of the background components of the sound field given that higher order basis functions are not generally required to represent these background portions of the sound field given the diffuse or background nature of these components. The techniques may therefore enable compression of diffuse or background aspects of the sound field while preserving the salient distinct components or aspects of the sound field through application of SVD to the SHC 121'.

The sound field component extraction unit 220 may perform a salience analysis with respect to the S matrix. The sound field component extraction unit 220 may analyze the diagonal values of the S matrix, selecting a variable D number of these components having the greatest value. In other words, the sound field component extraction unit 220 may determine the value D, which separates the two subspaces, by analyzing the slope of the curve created by the descending diagonal values of S, where the large singular values represent foreground or distinct sounds and the low singular values represent background components of the sound field. In some examples, the sound field component extraction unit 220 may use a first and a second derivative of the singular value curve. The sound field component extraction unit 220 may also limit the number D to be between one and five. As another example, the sound field component extraction unit 220 may limit the number D to be between one and $(N+1)^2$. Alternatively, the sound field component extraction unit 220 may pre-define the number D, such as to a value of four. In any event, once the number D is estimated, the sound field component extraction unit 220 extracts the foreground and background subspace from the matrices U, V and S.

In some examples, the sound field component extraction unit 220 may perform this analysis every M-samples, which may be restated as on a frame-by-frame basis. In this respect, D may vary from frame to frame. In other examples, the sound field component extraction unit 220 may perform this analysis more than once per frame, analyzing two or more portions of the frame. Accordingly, the techniques should not be limited in this respect to the examples described in this disclosure.

In effect, the sound field component extraction unit 220 may analyze the singular values of the diagonal S matrix, identifying those values having a relative value greater than the other values of the diagonal S matrix. The sound field component extraction unit 220 may identify D values, extracting these values to generate a distinct component or "foreground" matrix and a diffuse component or "background" matrix. The foreground matrix may represent a diagonal matrix comprising D columns having $(N+1)^2$ of the original S matrix. In some instances, the background matrix may represent a matrix having $(N+1)^2-D$ columns, each of which includes $(N+1)^2$ transformed spherical harmonic coefficients of the original S matrix. While described as a distinct matrix representing a matrix comprising D columns having $(N+1)^2$ values of the original S matrix, the sound field component extraction unit 220 may truncate this matrix to generate a foreground matrix having D columns having D values of the original S matrix, given that the S matrix is a diagonal matrix and the $(N+1)^2$ values of the D columns after the Dth value in each column is often a value of zero. While described with respect to a full foreground matrix and a full background matrix, the techniques may be implemented with respect to truncated versions of the distinct matrix and a truncated version of the background matrix. Accordingly, the techniques of this disclosure should not be limited in this respect.

In other words, the foreground matrix may be of a size D-by-$(N+1)^2$, while the background matrix may be of a size $(N+1)^2$–D-by-$(N+1)^2$. The foreground matrix may include those principal components or, in other words, singular values that are determined to be salient in terms of being distinct (DIST) audio components of the sound field, while the background matrix may include those singular values that are determined to be background (BG) or, in other words, ambient, diffuse, or non-distinct-audio components of the sound field.

The sound field component extraction unit 220 may also analyze the U matrix to generate the distinct and background matrices for the U matrix. Often, the sound field component extraction unit 220 may analyze the S matrix to identify the variable D, generating the distinct and background matrices for the U matrix based on the variable D.

The sound field component extraction unit 220 may also analyze the $V^T$ matrix 23 to generate distinct and background matrices for $V^T$. Often, the sound field component extraction unit 220 may analyze the S matrix to identify the variable D, generating the distinct and background matrices for $V^T$ based on the variable D.

Vector-based decomposition unit 202 may combine and output the various matrices obtained by compressing SHCs 121' as matrix multiplications (products) of the distinct and foreground matrices, which may produce a reconstructed portion of the sound field including SHCs 202. Sound field component extraction unit 220, meanwhile, may output the directional components 203 of the vector-based decomposition, which may include the distinct components of $V^T$. The audio encoding unit 128 may represent a unit that performs a form of encoding to further compress SHCs 202 to SHCs 204. In some instances, this audio encoding unit 128 may represent one or more instances of an advanced audio coding (AAC) encoding unit or unified speech and audio coding (USAC) unit. More information regarding how spherical harmonic coefficients may be encoded using an AAC encoding unit can be found in a convention paper by Eric Hellerud, et al., entitled "Encoding Higher Order Ambisonics with AAC," presented at the 124th Convention, 2008 May 17-20 and available at: http://ro.uow.edu.au/cgi/viewcontent.cgi?article=8025&context=engpapers.

In accordance with techniques described herein, the bitstream generation unit 130 may adjust or transform the sound field to reduce a number of the SHCs 204 that provide information relevant in describing the sound field. The term "adjusting" may refer to application of any matrix or matrixes that represents a linear invertible transform. In these instances, the bitstream generation unit 130 may specify adjustment information (which may also be referred to as "transformation information") in the bitstream describing how the sound field was adjusted. In particular, the bitstream generation unit 130 may generate the bitstream 131' to include directional components 203. While described as specifying this information in addition to the information identifying those of the SHCs 204 that are subsequently specified in the bitstream 131', this aspect of the techniques may be performed as an alternative to specifying information identifying those of the SHCs 204 that are included in the bitstream 131'. The techniques should therefore not be limited in this respect but may provide for a method of generating a bitstream comprised of a plurality of hierarchical elements that describe a sound field, where the method comprises adjusting the sound field to reduce a number of the plurality of hierarchical elements that provide information relevant in describing the sound field, and specifying adjustment information in the bitstream describing how the sound field was adjusted.

In some instances, the bitstream generation unit 130 may rotate the sound field to reduce a number of the SHCs 204 that provide information relevant in describing the sound field. In these instances, the bitstream generation unit 130 may first obtain rotation information for the sound field from directional components 203. Rotation information may comprise an azimuth value (capable of signaling 360 degrees) and an elevation value (capable of signaling 180 degrees). In some examples, the bitstream generation unit 130 may select one of a plurality of directional components (e.g., distinct audio objects) represented in directional components 203 according to a criteria. The criteria may be a largest vector magnitude indicating a largest sound amplitude; bitstream generation unit 130 may obtain this in some examples from the U matrix, S matrix, a combination thereof, or distinct components thereof. The criteria may be a combination or average of the directional components.

The bitstream generation unit 130 may, using the rotation information, rotate the sound field of SHCs 204 to reduce a number of SHCs 204 that provide information relevant in describing the sound field. The bitstream generation unit 130 may encode this reduced number of SHCs to the bitstream 131'.

The bitstream generation unit 130 may specify rotation information in the bitstream 131' describing how the sound field was rotated. In some instances, the bitstream generation unit 130 specify the rotation information by encoding the directional components 203, with which a corresponding renderer may independently obtain the rotation information for the sound field and "de-rotate" the rotated sound field, represented in reduced SHCs encoded to the bitstream 131', to extract and reconstitute the sound field as SHCs 204 from bitstream 131'. This process of rotating the renderer to rotate the render and in this way "de-rotate" the sound field is described in greater detail below with respect to renderer rotation unit 150 of FIGS. 6A-6B.

In some instances, the bitstream generation unit 130 encodes the rotation information directly, rather than indirectly via the directional components 203. In such instances, the azimuth value comprises one or more bits, and typically includes 10 bits. In some instances, the elevation value comprises one or more bits and typically includes at least 9 bits. This choice of bits allows, in the simplest embodiment, a resolution of 180/512 degrees (in both elevation and azimuth). In some instances, the adjustment may comprise the rotation and the adjustment information described above includes the rotation information. In some instances, the bitstream generation unit 131' may translate the sound field to reduce a number of the SHCs 204 that provide information relevant in describing the sound field. In these instances, the bitstream generation unit 130 may specify translation information in the bitstream 131' describing how the sound field was translated. In some instances, the adjustment may comprise the translation and the adjustment information described above includes the translation information.

Figure 6A:
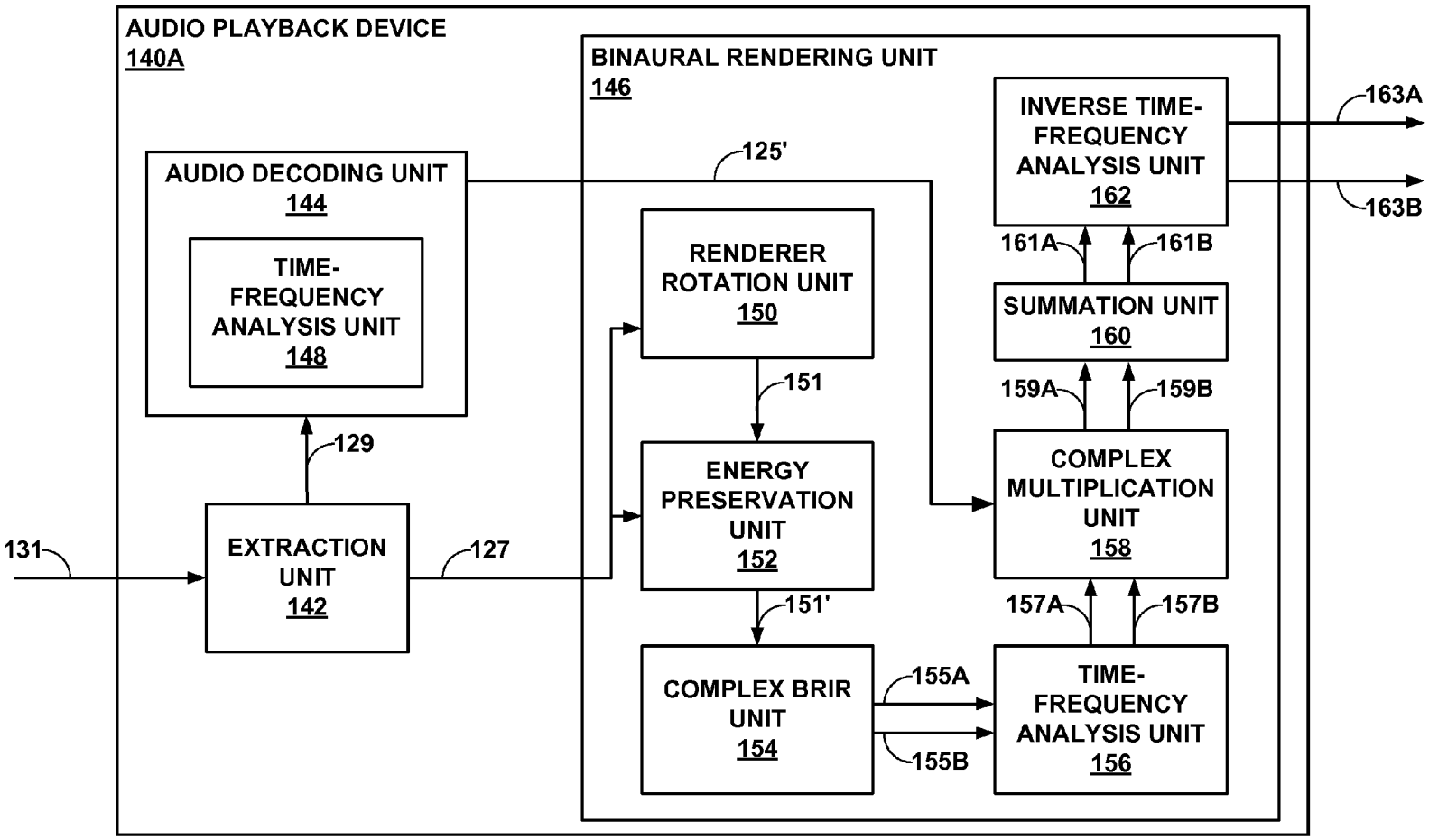
FIGS. 6A and 6B are each a block diagram illustrating an example of an audio playback device that may perform various aspects of the binaural audio rendering techniques described in this disclosure.
Figure 6B:
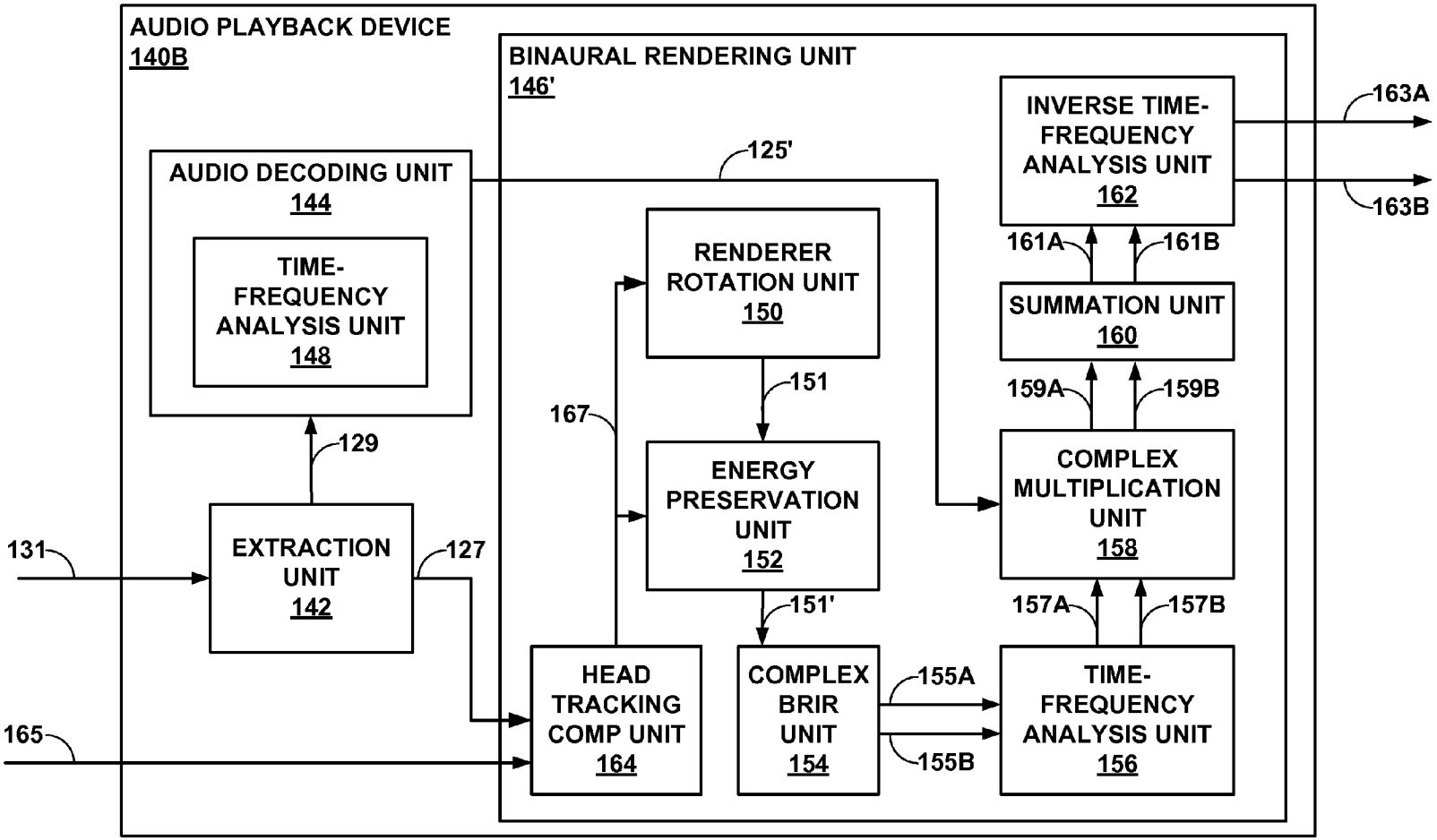

FIGS. 6A and 6B are each a block diagram illustrating an example of an audio playback device that may perform various aspects of the binaural audio rendering techniques described in this disclosure. While illustrated as a single device, i.e., audio playback device 140A in the example of FIG. 6A and audio playback device 140B in the example of FIG. 6B, the techniques may be performed by one or more devices. Accordingly, the techniques should be not limited in this respect.

As shown in the example of FIG. 6A, audio playback device 140A may include an extraction unit 142, an audio decoding unit 144 and a binaural rendering unit 146. The extraction unit 142 may represent a unit configured to extract, from bitstream 131, the encoded audio data 129 and the transformation information 127. The extraction unit 142 may forward the extracted encoded audio data 129 to the audio decoding unit 144, while passing the transformation information 127 to the binaural rendering unit 146.

The audio decoding unit 144 may represent a unit configured to decode the encoded audio data 129 so as to generate the SHC 125' The audio decoding unit 144 may perform an audio decoding process reciprocal to the audio encoding process used to encode the SHC 125'. As shown in the example of FIG. 6A, the audio decoding unit 144 may include a time-frequency analysis unit 148, which may represent a unit configured to transform the SHC 125 from the time domain to the frequency domain, thereby generating the SHC 125'. That is, when the encoded audio data 129 represents a compressed form of the SHC 125 that is not converted from the time domain to the frequency domain, the audio decoding unit 144 may invoke the time-frequency analysis unit 148 to convert the SHC 125 from the time domain to the frequency domain so as to generate the SHC 125' (specified in the frequency domain). In some instances, the SHC 125 may already be specified in the frequency domain. In these instances, the time-frequency analysis unit 148 may pass the SHC 125' to the binaural rendering unit 146 without applying a transform or otherwise transforming the received SHC 121. While described with respect to the SHC 125' specified in the frequency domain, the techniques may be performed with respect the SHC 125 specified in the time domain.

The binaural rendering unit 146 represents a unit configured to binauralize the SHC 125'. The binauralize rendering unit 146 may, in other words, represent a unit configured to render the SHC 125' to a left and right channel, which may feature spatialization to model how the left and right channel would be heard by a listener in a room in which the SHC 125' were recorded. The binaural rendering unit 146 may render the SHC 125' to generate a left channel 163A and a right channel 163B (which may collectively be referred to as "channels 163") suitable for playback via a headset, such as headphones. As shown in the example of FIG. 6A, the binaural rendering unit 146 includes a renderer rotation unit 150, an energy preservation unit 152, a complex binaural room impulse response (BRIR) unit 154, a time frequency analysis unit 156, a complex multiplication unit 158, a summation unit 160 and an inverse time-frequency analysis unit 162.

The renderer rotation unit 150 may represent a unit configured to output a renderer 151 having a rotated frame of reference. The renderer rotation unit 150 may rotate or otherwise transform a renderer having a standard frame of reference (often, a frame of reference specified for rendering 22 channels from the SHC 125') based on the transformation information 127. In other words, the renderer rotation unit 150 may effectively reposition the speakers rather than rotate the soundfield expressed by the SHC 125' back to align the coordinate systems of the speakers with that of the coordinate system of the microphone. The renderer rotation unit 150 may output a rotated renderer 151 that may be defined by a matrix of size L rows×$(N+1)^2-U$ columns, where the variable L denotes the number of loudspeakers (either real or virtual), the variable N denotes a highest order of a basis function to which one of the SHC 125' corresponds, and the variable U denotes the number of the SHC 121' removed when generating the SHC 125' during the encoding process. Often, this number U is derived from the SHC present field 50 described above, which may also be referred to herein as a "bit inclusion map."

The renderer rotation unit 150 may rotate the renderer to reduce computation complexity when rendering the SHC 125'. To illustrate, consider that if the renderer were not rotated, the binaural rendering unit 146 would rotate the SHC 125' to generate the SHC 125, which may include more SHC in comparison to the SHC 125'. By increasing the number of the SHC when operating with respect to the SHC 125, the binaural rendering unit 146 may perform more mathematical operations in comparison to operating with respect to the reduced set of the SHC, i.e., SHC 125' in the example of FIG. 6B. Accordingly, by rotating the frame of reference and outputting the rotated renderer 151, the renderer rotation unit 150 may reduce the complexity of binaurally rendering the SHC 125' (mathematically), which may result in more efficient rendering of the SHC 125' (in terms of processing cycles, storage consumption, etc.).

The renderer rotation unit 150 may also, in some instances, present a graphical user interface (GUI) or other interface via a display, to provide a user with a way to control how the renderer is rotated. In some instances, the user may interact with this GUI or other interface to input this user controlled rotation by specifying a theta control. The renderer rotation unit 150 may then adjust the transformation information by this theta control to tailor rendering to user-specific feedback. In this manner, the renderer rotation unit 150 may facilitate user-specific control of the binauralization process to promote and/or improve (subjectively) the binauralization of the SHC 125'.

The energy preservation unit 152 represents a unit configured to perform an energy preservation process to potentially reintroduce some energy lost when some amount of the SHC are lost due to application of a threshold or other similar types of operations. More information regarding energy preservation may be found in a paper by F. Zotter et al., entitled "Energy-Preserving Ambisonic Decoding," published in ACTA ACUSTICA UNITED with ACUSTICA, Vol. 98, 2012, on pages 37-47. Typically, the energy preservation unit 152 increases the energy in an attempt to recover or maintain the volume of the audio data as originally recorded. The energy preservation unit 152 may operates on the matrix coefficients of the rotated renderer 151 to generate an energy preserved rotated renderer, which is denoted as renderer 151'. The energy preservation unit 152 may output renderer 151' that may be defined by a matrix of size L rows×$(N+1)^2-U$ columns.

Complex binaural room impulse response (BRIR) unit 154 represents a unit configured to perform an element-by-element complex multiplication and summation with respect to the renderer 151' and one or more BRIR matrices to generate two BRIR rendering vectors 155A and 155B. Mathematically, this can be expressed according to the following equations (1)-(5):

$$D'=DR_{xy,xz,yz} \tag{1}$$

where D' denotes the rotated renderer of renderer D using rotation matrix R based on one or all of an angle specified with respect to the x-axis and y-axis (xy), the x-axis and the z-axis (xz), and the y-axis and the z-axis (yz).

$$BRIR'_{H,left}=\Sigma_{spk=1}^{L}BRIR_{spk,left}D'_{H,spk} \quad (2)$$

$$BRIR'_{H,right}=\Sigma_{spk=1}^{L}BRIR_{spk,right}D'_{H,spk} \quad (3)$$

In the above equations (2) and (3), the "spk" subscript in BRIR and D' indicates that both of BRIR and D' have the same angular position. In other words, the BRIR represents a virtual loudspeaker layout for which D is designed. The 'H' subscript of BRIR' and D' represents the SH element positions and goes through the SH element positions. BRIR' represents the BRIRs transformed form the spatial domain to the HOA domain (as a spherical harmonic inverse ($SH^{-1}$) type of representation). The above equations (2) and (3) may be performed for all $(N+1)^2$ positions H in the renderer matrix D which is the SH dimensions. BRIR may be expressed either in the time domain or the frequency domain, where it remains a multiplication. The subscribe "left" and "right" refers to the BRIR/BRIR' for the left channel or ear and the BRIR/BRIR' for the right channel or ear.

$$BRIR''_{left}(w)\Sigma_{H=1}^{(N+1)^2}BRIR'_{H,left}(w)HOA_H(w) \quad (4)$$

$$BRIR''_{right}(w)\Sigma_{H=1}^{(N+1)^2}BRIR'_{H,right}(w)HOA_H(w) \quad (4)$$

In the above equations (4) and (5), the BRIR" refers to the left/right signal in the frequency domain. H again loops through the SH coefficients (which may also be referred to as positions), where the sequential order is the same in higher order ambisonics (HOA) and BRIR'. Typically, this process is performed as a multiplication in the frequency domain or a convolution in the time domain. In this way, the BRIR matrices may include a left BRIR matrix for binaurally rendering the left channel 163A and a right BRIR matrix for binaurally rendering the right channel 163B. The complex BRIR unit 154 outputs vectors 155A and 155B ("vectors 155") to the time frequency analysis unit 156.

The time frequency analysis unit 156 may be similar to the time frequency analysis unit 148 described above, except that the time frequency analysis unit 156 may operate on the vectors 155 to transform the vectors 155 from the time domain to the frequency domain, thereby generating two binaural rendering matrices 157A and 157B ("binaural rendering matrices 157") specified in the frequency domain. The transform may comprise a 1024-point transform that effectively generates a $(N+1)^2-U$ row by 1024 (or any other number of point) for each of the vectors 155, which may be denoted as binaural rendering matrices 157. The time frequency analysis unit 156 may output these matrices 157 to the complex multiplication unit 158. In instances where the techniques are performed in the time domain, the time frequency analysis unit 156 may pass the vectors 155 to the complex multiplication unit 158. In instances where the previous units 150, 152 and 154 operate in the frequency domain, the time frequency analysis unit 156 may pass the matrices 157 (which in these instances are generated by the complex BRIR unit 154) to the complex multiplication unit 158.

The complex multiplication unit 158 may represent a unit configured to perform the element-by-element complex multiplication of the SHC 125' by each of the matrixes 157 to generate two matrices 159A and 159B ("matrices 159") of size $(N+1)^2-U$ rows by 1024 (or any other number of transform points) columns. The complex multiplication unit 158 may output these matrices 159 to the summation unit 160.

The summation unit 160 may represent a unit configured to sum over all $(N+1)^2-U$ rows of each of matrices 159. To illustrate, the summation unit 160 sums the values along the first row of matrix 159A, then sums the values of the second row, the third row and so on to generate a vector 161A having a single row and 1024 (or other transform point number) columns. Likewise, the summation unit 160 sums the values along each of the rows of the matrix 159B to generate a vector 161B having a single row and 1024 (or some other transform point number) columns. The summation unit 160 outputs these vectors 161A and 161B ("vectors 161") to the inverse time-frequency analysis unit 162.

The inverse time-frequency analysis unit 162 may represent a unit configured to perform an inverse transform to transform data from the frequency domain to the time domain. The inverse time-frequency analysis unit 162 may receive vectors 161 and transform each of vectors 161 from the frequency domain to the time domain through application of a transform that is inverse to the transform used to transform the vectors 161 (or a derivation thereof) from the time domain to the frequency domain. The inverse time-frequency analysis unit 162 may transform the vectors 161 from the frequency domain to the time domain so as to generate binauralized left and right channels 163.

In operation, the binaural rendering unit 146 may determine transformation information. The transformation information may describe how a sound field was transformed to reduce a number of the plurality of hierarchical elements providing information relevant in describing the sound field (i.e., SHC 125' in the example of FIGS. 6A-6B). The binaural rendering unit 146 may then perform the binaural audio rendering with respect to the reduced plurality of hierarchical elements based on the determined transformation information 127, as described above.

In some instances, when performing the binaural audio rendering, the binaural rendering unit 146 may transform a frame of reference by which to render the SHC 125' to the plurality of channels 163 based on the determined transformation information 127.

In some instances, the transformation information 127 comprises rotation information that specifies at least an elevation angle and an azimuth angle by which the sound field was rotated. In these instances, the binaural rendering unit 146 may, when performing the binaural audio rendering, rotate a frame of reference by which a rendering function is to render the SHC 125' based on the determined rotation information.

In some instances, the binaural rendering unit 146 may, when performing the binaural audio rendering, transform a frame of reference by which a rendering function is to render the SHC 125' based on the determined transformation information 127, and apply an energy preservation function with respect to the transformed rendering function.

In some instances, the binaural rendering unit 146 may, when performing the binaural audio rendering, transform a frame of reference by which a rendering function is to render the SHC 125' based on the determined transformation information 127, and combine the transformed rendering function with a complex binaural room impulse response function using multiplication operations.

In some instances, the binaural rendering unit 146 may, when performing the binaural audio rendering, transform a frame of reference by which a rendering function is to render the SHC 125' based on the determined transformation information 127, and combining the transformed rendering function with a complex binaural room impulse response function using multiplication operations and without requiring convolution operations.

In some instances, the binaural rendering unit 146 may, when performing the binaural audio rendering, transforming a frame of reference by which a rendering function is to render the SHC 125' based on the determined transformation information 127, combine the transformed rendering function with a complex binaural room impulse response function to generate a rotated binaural audio rendering function, and apply the rotated binaural audio rendering function to the SHC 125' to generate left and right channels 163.

In some instances, the audio playback device 140A may, in addition to invoking the binaural rendering unit 146 to perform the binauralization described above, retrieve a bitstream 131 that includes encoded audio data 129 and the transformation information 127, parse the encoded audio data 129 from the bitstream 131, and invoke the audio decoding unit 144 to decode the parsed encoded audio data 129 to generate the SHC 125'. In these instances, the audio playback device 140A may invoke the extraction unit 142 to determine the transformation information 127 by parsing the transformation information 127 from the bitstream 131.

In some instances, the audio playback device 140A may, in addition to invoking the binaural rendering unit 146 to perform the binauralization described above, retrieve a bitstream 131 that includes encoded audio data 129 and the transformation information 127, parse the encoded audio data 129 from the bitstream 131, and invoke the audio decoding unit 144 to decode the parsed encoded audio data 129 in accordance with an advanced audio coding (AAC) scheme to generate the SHC 125'. In these instances, the audio playback device 140A may invoke the extraction unit 142 to determine the transformation information 127 by parsing the transformation information 127 from the bitstream 131.

FIG. 6B is a block diagram illustrating another example of an audio playback device 140B that may perform various aspects of the techniques described in this disclosure. The audio playback device 140 may be substantially similar to the audio playback device 140A in that the audio playback device 140B includes an extraction unit 142 and an audio decoding unit 144 that are the same as those included within the audio playback device 140A. Moreover, the audio playback device 140B includes a binaural rendering unit 146' that is substantially similar to the binaural rendering unit 146 of the audio playback device 140A, except the binaural rendering unit 146' further includes a head tracking compensation unit 164 ("head tracking comp unit 164") in addition to the renderer rotation unit 150, the energy preservation unit 152, the complex BRIR unit 154, the time frequency analysis unit 156, the complex multiplication unit 158, the summation unit 160 and the inverse time-frequency analysis unit 162 described in more detail above with respect to the binaural rendering unit 146.

The head tracking compensation unit 164 may represent a unit configured to receive head tracking information 165 and the transformation information 127, process the transformation information 127 based on the head tracking information 165 and output updated transformation information 127. The head tracking information 165 may specify an azimuth angle and an elevation angle (or, in other words, one or more spherical coordinates) relative to what is perceived or configured as the playback frame of reference.

That is, a user may be seated facing a display, such as a television, which the headphones may locate using any number of location identification mechanisms, including acoustic location mechanisms, wireless triangulation mechanisms, and the like. The head of the user may rotate relative to this frame of reference, which the headphones may detect and provide as the head tracking information 165 to the head tracking compensation unit 164. The head tracking compensation unit 164 may then adjust the transformation information 127 based on the head tracking information 165 to account for the movement of the user or listener's head, thereby generating the updated transformation information 167. Both the renderer rotation unit 150 and the energy preservation unit 152 may then operate with respect to this updated transformation unit information 167.

In this way, the head tracking compensation unit 164 may determine a position of a head of a listener relative to the sound field represented by the SHC 125', e.g., by determining the head tracking information 165. The head tracking compensation unit 164 may determine the updated transformation information 167 based on the determined transformation information 127 and the determined position of the head of the listener, e.g., the head tracking information 165. The remaining units of the binaural rendering unit 146' may, when performing the binaural audio rendering, perform the binaural audio rendering with respect to the SHC 125' based on the updated transformation information 167 in a manner similar to that described above with respect to audio playback device 140A.

Figure 7:
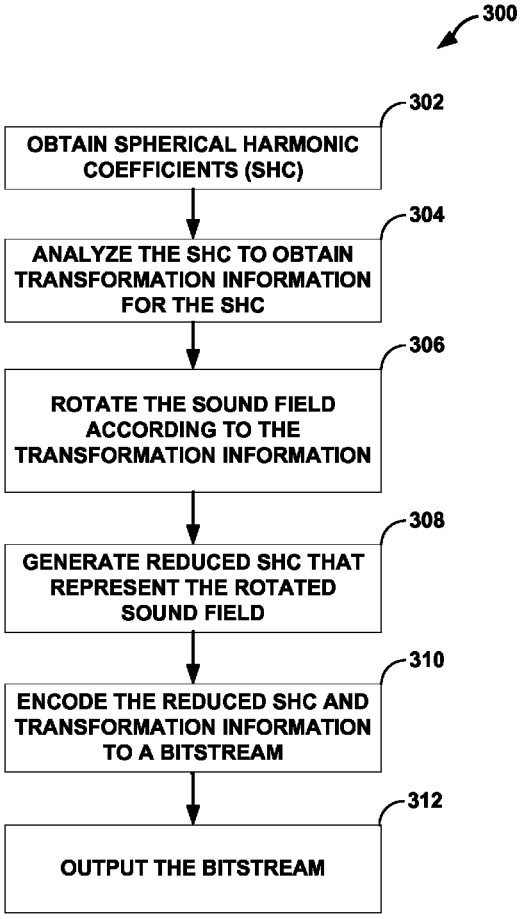
FIG. 7 is a flowchart illustrating an example mode of operation performed by an audio encoding device in accordance with various aspects of the techniques described in this disclosure.

FIG. 7 is a flowchart illustrating an example mode of operation performed by an audio encoding device in accordance with various aspects of the techniques described in this disclosure. To convert a spatial sound field that is typically reproduced over L loudspeakers to a binaural headphone representation L×2 convolutions may be required on a per audio frame basis. As a result, this conventional binauralization methodology may be considered computationally expensive in a streaming scenario, whereby a frame of audio has to be processed and outputted in non-interrupted real-time. Depending on the hardware used this conventional binauralization process may require more computational cost than is available. This conventional binauralization process may be improved by performing a frequency-domain multiplication instead of a time-domain convolution as well as by using block wise convolution in order to reduce computational complexity. Applying this binauralization model to HOA in general may further increase the complexity due to the need of more loudspeaker than HOA coefficients $(N+1)^2$ to potentially correctly reproduce the desired sound field.

By contrast, in the example of FIG. 7, an audio encoding device may apply example mode of operation 300 to rotate a sound field to reduce a number of SHCs. Mode of operation 300 is described with respect to audio encoding device 120 of FIG. 5A. Audio encoding device 120 obtains spherical harmonic coefficients (302), and analyzes the SHC to obtain transformation information for the SHC (304). The audio encoding device 120 rotates the sound field represented by the SHC according to the transformation information (306). The audio encoding device 120 generates reduced spherical harmonic coefficients ("reduced SHC") that represented the rotated sound field (308). The audio encoding device 120 may additionally encode the reduced SHC as well as the transformation information to a bitstream (310) and output or store the bitstream (312).

Figure 8:
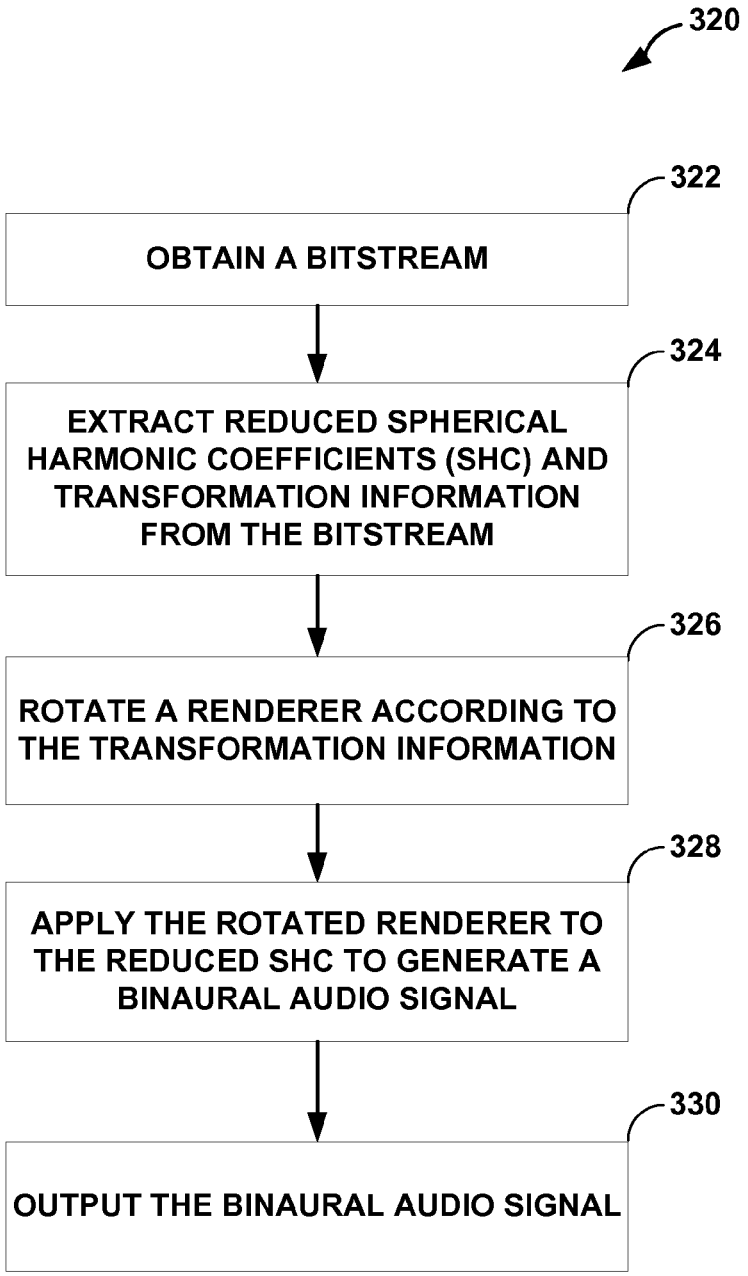
FIG. 8 is a flowchart illustrating an example mode of operation performed by an audio playback device in accordance with various aspects of the techniques described in this disclosure.

FIG. 8 is a flowchart illustrating an example mode of operation performed by an audio playback device (or "audio decoding device") in accordance with various aspects of the techniques described in this disclosure. The techniques may provide both for an HOA signal that may be optimally rotated so as to increase the number of SHC that are under a threshold, and thereby result in an increased removal of the SHC. When removed, the resulting SHC may be played back such that the removal of the SHC is unperceivable (given that these SHC are not salient in describing the sound field). This transformation information (theta and phi or (θ,)) is transmitted to the decoding engine and then to the binaural reproduction methodology (which is described above in more detail). The techniques of this disclosure may first rotate the desired HOA renderer from the transformation (or, in this instance, rotation) information transmitted form the spatial analysis block of the encoding engine so that the coordinate systems have been equally rotated. Following on the discarded HOA coefficients are also discarded from the rendering matrix. Optionally, the modified renderer can be energy preserved using a sound source at the rotated coordinates that have been transmitted. The rendering matrix may be multiplied with the BRIRs of the intended loudspeaker positions for both the left and right ears, and then summed across the L loudspeaker dimension. At this point, if the signal is not in the frequency domain, it may be transformed into the frequency domain. After which, a complex multiplication may be performed to binauralize the HOA signal coefficients. By then summing over the HOA coefficient dimension, the renderer may be applied to the signal and a two channel frequency-domain signal may be obtained. The signal may finally be transformed into the time-domain for auditioning of the signal.

In the example of FIG. 8, an audio playback device may apply example mode of operation 320. Mode of operation 320 is described hereinafter with respect to audio playback device 140A of FIG. 6A. The audio playback device 140A obtains a bitstream (322) and extracts reduced spherical harmonic coefficients (SHC) and transformation information from the bitstream (324). The audio playback device 140A further rotates a renderer to according to the transformation information (326) and applies the rotated renderer to the reduced SHC to generate a binaural audio signal (328). The audio playback device 140A outputs the binaural audio signal (330).

A benefit of the techniques described in this disclosure may be that computational expense is saved by performing multiplications rather than convolutions. A lower number of multiplications may be needed, first because the HOA count should be less than the number of loudspeakers, and secondly because of the reduction of HOA coefficients via optimal rotation. Since most audio codecs are based in the frequency domain it may be assumed that frequency-domain signals rather than time-domain signals can be outputted. Also the BRIRs may be saved in the frequency domain rather than time-domain potentially saving computation of on-the-fly Fourier based transforms.

Figure 9:
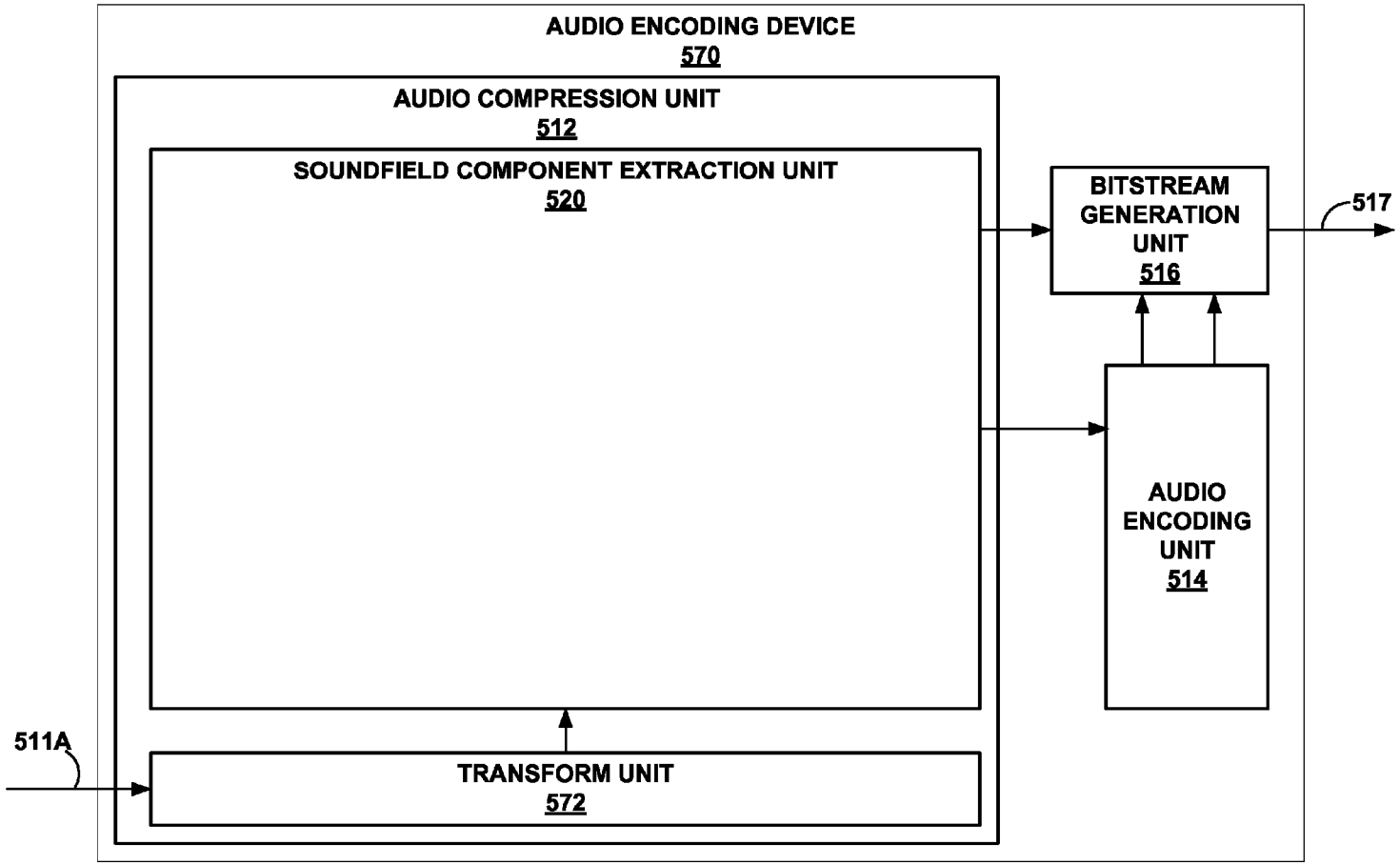
FIG. 9 is a block diagram illustrating another example of an audio encoding device that may perform various aspects of the techniques described in this disclosure.

FIG. 9 is a block diagram illustrating another example of an audio encoding device 570 that may perform various aspects of the techniques described in this disclosure. In the example of FIG. 9, an order reduction unit is assumed to be included within soundfield component extraction unit 520 but is not shown for ease of illustration purposes. However, the audio encoding device 570 may include a more general transformation unit 572 that may comprise a decomposition unit in some examples.

Figure 10:
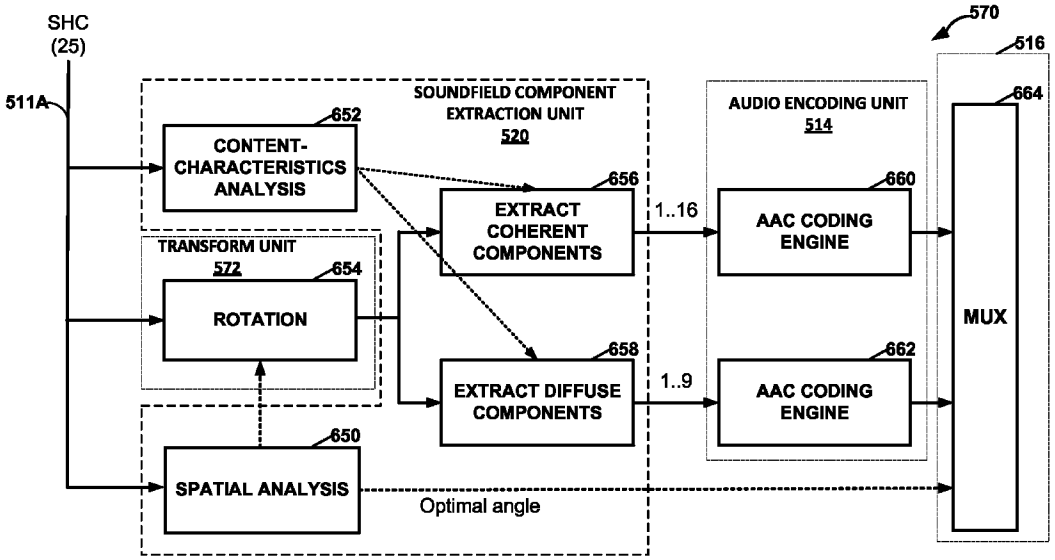
FIG. 10 is a block diagram illustrating, in more detail, an example implementation of the audio encoding device shown in the example of FIG. 9.

FIG. 10 is a block diagram illustrating, in more detail, an example implementation of the audio encoding device 570 shown in the example of FIG. 9. As illustrated in the example of FIG. 10, the transform unit 572 of the audio encoding device 570 includes a rotation unit 654. The soundfield component extraction unit 520 of the audio encoding device 570 includes a spatial analysis unit 650, a content-characteristics analysis unit 652, an extract coherent components unit 656, and an extract diffuse components unit 658. The audio encoding unit 514 of the audio encoding device 570 includes an AAC coding engine 660 and an AAC coding engine 162. The bitstream generation unit 516 of the audio encoding device 570 includes a multiplexer (MUX) 164.

The bandwidth—in terms of bits/second—required to represent 3D audio data in the form of SHC may make it prohibitive in terms of consumer use. For example, when using a sampling rate of 48 kHz, and with 32 bits/same resolution—a fourth order SHC representation represents a bandwidth of 36 Mbits/second (25×48000×32 bps). When compared to the state-of-the-art audio coding for stereo signals, which is typically about 100 kbits/second, this is a large figure. Techniques implemented in the example of FIG. 10 may reduce the bandwidth of 3D audio representations.

The spatial analysis unit 650, the content-characteristics analysis unit 652, and the rotation unit 654 may receive SHC 511A. As described elsewhere in this disclosure, the SHC 511A may be representative of a soundfield. SHC 511A may represent an example of SHC 27 or HOA coefficients 11. In the example of FIG. 10, the spatial analysis unit 650, the content-characteristics analysis unit 652, and the rotation unit 654 may receive twenty-five SHC for a fourth order (n=4) representation of the soundfield.

The spatial analysis unit 650 may analyze the soundfield represented by the SHC 511A to identify distinct components of the soundfield and diffuse components of the soundfield. The distinct components of the soundfield are sounds that are perceived to come from an identifiable direction or that are otherwise distinct from background or diffuse components of the soundfield. For instance, the sound generated by an individual musical instrument may be perceived to come from an identifiable direction. In contrast, diffuse or background components of the soundfield are not perceived to come from an identifiable direction. For instance, the sound of wind through a forest may be a diffuse component of a soundfield.

The spatial analysis unit 650 may identify one or more distinct components attempting to identify an optimal angle by which to rotate the soundfield to align those of the distinct components having the most energy with the vertical and/or horizontal axis (relative to a presumed microphone that recorded this soundfield). The spatial analysis unit 650 may identify this optimal angle so that the soundfield may be rotated such that these distinct components better align with the underlying spherical basis functions shown in the examples of FIGS. 1 and 2.

In some examples, the spatial analysis unit 650 may represent a unit configured to perform a form of diffusion analysis to identify a percentage of the soundfield represented by the SHC 511A that includes diffuse sounds (which may refer to sounds having low levels of direction or lower order SHC, meaning those of SHC 511A having an order less than or equal to one). As one example, the spatial analysis unit 650 may perform diffusion analysis in a manner similar to that described in a paper by Ville Pulkki, entitled "Spatial Sound Reproduction with Directional Audio Coding," published in the J. Audio Eng. Soc., Vol. 55, No. 6, dated June 2007. In some instances, the spatial analysis unit 650 may only analyze a non-zero subset of the HOA coefficients, such as the zero and first order ones of the SHC 511A, when performing the diffusion analysis to determine the diffusion percentage.

The content-characteristics analysis unit 652 may determine, based at least in part on the SHC 511A, whether the SHC 511A were generated via a natural recording of a soundfield or produced artificially (i.e., synthetically) from, as one example, an audio object, such as a PCM object. Furthermore, the content-characteristics analysis unit 652 may then determine, based at least in part on whether SHC 511A were generated via an actual recording of a soundfield or from an artificial audio object, the total number of channels to include in the bitstream 517. For example, the content-characteristics analysis unit 652 may determine, based at least in part on whether the SHC 511A were generated from a recording of an actual soundfield or from an artificial audio object, that the bitstream 517 is to include sixteen channels. Each of the channels may be a mono channel. The content-characteristics analysis unit 652 may further perform the determination of the total number of channels to include in the bitstream 517 based on an output bitrate of the bitstream 517, e.g., 1.2 Mbps.

In addition, the content-characteristics analysis unit 652 may determine, based at least in part on whether the SHC 511A were generated from a recording of an actual soundfield or from an artificial audio object, how many of the channels to allocate to coherent or, in other words, distinct components of the soundfield and how many of the channels to allocate to diffuse or, in other words, background components of the soundfield. For example, when the SHC 511A were generated from a recording of an actual soundfield using, as one example, an Eigenmic, the content-characteristics analysis unit 652 may allocate three of the channels to coherent components of the soundfield and may allocate the remaining channels to diffuse components of the soundfield. In this example, when the SHC 511A were generated from an artificial audio object, the content-characteristics analysis unit 652 may allocate five of the channels to coherent components of the soundfield and may allocate the remaining channels to diffuse components of the soundfield. In this way, the content analysis block (i.e., content-characteristics analysis unit 652) may determine the type of soundfield (e.g., diffuse/directional, etc.) and in turn determine the number of coherent/diffuse components to extract.

The target bit rate may influence the number of components and the bitrate of the individual AAC coding engines (e.g., AAC coding engines 660, 662). In other words, the content-characteristics analysis unit 652 may further perform the determination of how many channels to allocate to coherent components and how many channels to allocate to diffuse components based on an output bitrate of the bitstream 517, e.g., 1.2 Mbps.

In some examples, the channels allocated to coherent components of the soundfield may have greater bit rates than the channels allocated to diffuse components of the soundfield. For example, a maximum bitrate of the bitstream 517 may be 1.2 Mb/sec. In this example, there may be four channels allocated to coherent components and 16 channels allocated to diffuse components. Furthermore, in this example, each of the channels allocated to the coherent components may have a maximum bitrate of 64 kb/sec. In this example, each of the channels allocated to the diffuse components may have a maximum bitrate of 48 kb/sec.

As indicated above, the content-characteristics analysis unit 652 may determine whether the SHC 511A were generated from a recording of an actual soundfield or from an artificial audio object. The content-characteristics analysis unit 652 may make this determination in various ways. For example, the audio encoding device 570 may use $4^{th}$ order SHC. In this example, the content-characteristics analysis unit 652 may code 24 channels and predict a $25^{th}$ channel (which may be represented as a vector). The content-characteristics analysis unit 652 may apply scalars to at least some of the 24 channels and add the resulting values to determine the $25^{th}$ vector. Furthermore, in this example, the content-characteristics analysis unit 652 may determine an accuracy of the predicted $25^{th}$ channel. In this example, if the accuracy of the predicted $25^{th}$ channel is relatively high (e.g., the accuracy exceeds a particular threshold), the SHC 511A is likely to be generated from a synthetic audio object. In contrast, if the accuracy of the predicted $25^{th}$ channel is relatively low (e.g., the accuracy is below the particular threshold), the SHC 511A is more likely to represent a recorded soundfield. For instance, in this example, if a signal-to-noise ratio (SNR) of the $25^{th}$ channel is over 100 decibels (dbs), the SHC 511A are more likely to represent a soundfield generated from a synthetic audio object. In contrast, the SNR of a soundfield recorded using an eigen microphone may be 5 to 20 dbs. Thus, there may be an apparent demarcation in SNR ratios between soundfield represented by the SHC 511A generated from an actual direct recording and from a synthetic audio object.

Furthermore, the content-characteristics analysis unit 652 may select, based at least in part on whether the SHC 511A were generated from a recording of an actual soundfield or from an artificial audio object, codebooks for quantizing the V vector. In other words, the content-characteristics analysis unit 652 may select different codebooks for use in quantizing the V vector, depending on whether the soundfield represented by the HOA coefficients is recorded or synthetic.

In some examples, the content-characteristics analysis unit 652 may determine, on a recurring basis, whether the SHC 511A were generated from a recording of an actual soundfield or from an artificial audio object. In some such examples, the recurring basis may be every frame. In other examples, the content-characteristics analysis unit 652 may perform this determination once. Furthermore, the content-characteristics analysis unit 652 may determine, on a recurring basis, the total number of channels and the allocation of coherent component channels and diffuse component channels. In some such examples, the recurring basis may be every frame. In other examples, the content-characteristics analysis unit 652 may perform this determination once. In some examples, the content-characteristics analysis unit 652 may select, on a recurring basis, codebooks for use in quantizing the V vector. In some such examples, the recurring basis may be every frame. In other examples, the content-characteristics analysis unit 652 may perform this determination once.

The rotation unit 654 may perform a rotation operation of the HOA coefficients. As discussed elsewhere in this disclosure (e.g., with respect to FIGS. 11A and 11B), performing the rotation operation may reduce the number of bits required to represent the SHC 511A. In some examples, the rotation analysis performed by the rotation unit 652 is an instance of a singular value decomposition ("SVD") analysis. Principal component analysis ("PCA"), independent component analysis ("ICA"), and Karhunen-Loeve Transform ("KLT") are related techniques that may be applicable.

In the example of FIG. 10, the extract coherent components unit 656 receives rotated SHC 511A from rotation unit 654. Furthermore, the extract coherent components unit 656 extracts, from the rotated SHC 511A, those of the rotated SHC 511A associated with the coherent components of the soundfield.

In addition, the extract coherent components unit 656 generates one or more coherent component channels. Each of the coherent component channels may include a different subset of the rotated SHC 511A associated with the coherent coefficients of the soundfield. In the example of FIG. 10, the extract coherent components unit 656 may generate from one to 16 coherent component channels. The number of coherent component channels generated by the extract coherent components unit 656 may be determined by the number of channels allocated by the content-characteristics analysis unit 652 to the coherent components of the soundfield. The bitrates of the coherent component channels generated by the extract coherent components unit 656 may be the determined by the content-characteristics analysis unit 652.

Similarly, in the example of FIG. 10, extract diffuse components unit 658 receives rotated SHC 511A from rotation unit 654. Furthermore, the extract diffuse components unit 658 extracts, from the rotated SHC 511A, those of the rotated SHC 511A associated with diffuse components of the soundfield.

In addition, the extract diffuse components unit 658 generates one or more diffuse component channels. Each of the diffuse component channels may include a different subset of the rotated SHC 511A associated with the diffuse coefficients of the soundfield. In the example of FIG. 10, the extract diffuse components unit 658 may generate from one to 9 diffuse component channels. The number of diffuse component channels generated by the extract diffuse components unit 658 may be determined by the number of channels allocated by the content-characteristics analysis unit 652 to the diffuse components of the soundfield. The bitrates of the diffuse component channels generated by the extract diffuse components unit 658 may be the determined by the content-characteristics analysis unit 652.

In the example of FIG. 10, AAC coding unit 660 may use an AAC codec to encode the coherent component channels generated by extract coherent components unit 656. Similarly, AAC coding unit 662 may use an AAC codec to encode the diffuse component channels generated by extract diffuse components unit 658. The multiplexer 664 ("MUX 664") may multiplex the encoded coherent component channels and the encoded diffuse component channels, along with side data (e.g., an optimal angle determined by spatial analysis unit 650), to generate the bitstream 517.

In this way, the techniques may enable the audio encoding device 570 to determine whether spherical harmonic coefficients representative of a soundfield are generated from a synthetic audio object.

In some examples, the audio encoding device 570 may determine, based on whether the spherical harmonic coefficients are generated from a synthetic audio object, a subset of the spherical harmonic coefficients representative of distinct components of the soundfield. In these and other examples, the audio encoding device 570 may generate a bitstream to include the subset of the spherical harmonic coefficients. The audio encoding device 570 may, in some instances, audio encode the subset of the spherical harmonic coefficients, and generate a bitstream to include the audio encoded subset of the spherical harmonic coefficients.

In some examples, the audio encoding device 570 may determine, based on whether the spherical harmonic coefficients are generated from a synthetic audio object, a subset of the spherical harmonic coefficients representative of background components of the soundfield. In these and other examples, the audio encoding device 570 may generate a bitstream to include the subset of the spherical harmonic coefficients. In these and other examples, the audio encoding device 570 may audio encode the subset of the spherical harmonic coefficients, and generate a bitstream to include the audio encoded subset of the spherical harmonic coefficients.

In some examples, the audio encoding device 570 may perform a spatial analysis with respect to the spherical harmonic coefficients to identify an angle by which to rotate the soundfield represented by the spherical harmonic coefficients and perform a rotation operation to rotate the soundfield by the identified angle to generate rotated spherical harmonic coefficients.

In some examples, the audio encoding device 570 may determine, based on whether the spherical harmonic coefficients are generated from a synthetic audio object, a first subset of the spherical harmonic coefficients representative of distinct components of the soundfield, and determine, based on whether the spherical harmonic coefficients are generated from a synthetic audio object, a second subset of the spherical harmonic coefficients representative of background components of the soundfield. In these and other examples, the audio encoding device 570 may audio encode the first subset of the spherical harmonic coefficients having a higher target bitrate than that used to audio encode the second subject of the spherical harmonic coefficients.

Figure 11B:
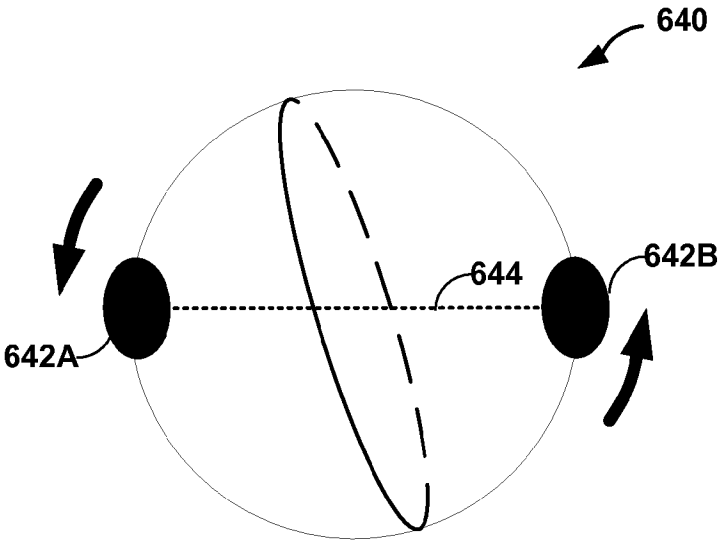
FIGS. 11A and 11B are diagrams illustrating an example of performing various aspects of the techniques described in this disclosure to rotate a soundfield.
Figure 11A:
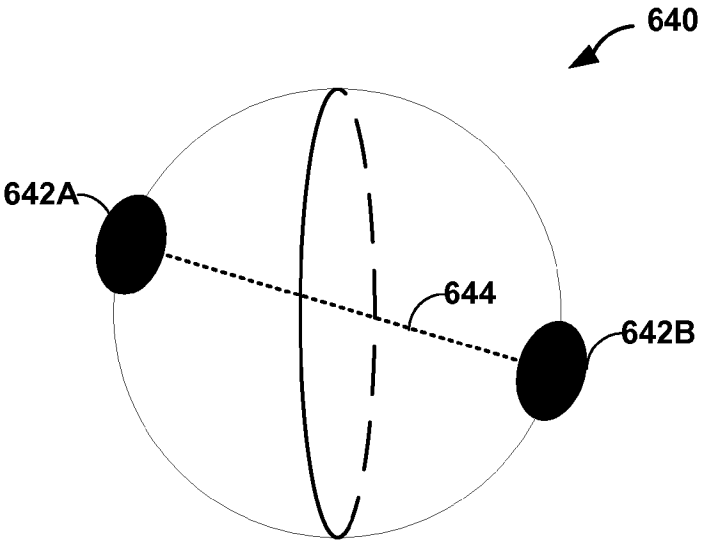

FIGS. 11A and 11B are diagrams illustrating an example of performing various aspects of the techniques described in this disclosure to rotate a soundfield 640. FIG. 11A is a diagram illustrating soundfield 640 prior to rotation in accordance with the various aspects of the techniques described in this disclosure. In the example of FIG. 11A, the soundfield 640 includes two locations of high pressure, denoted as location 642A and 642B. These location 642A and 642B ("locations 642") reside along a line 644 that has a non-zero slope (which is another way of referring to a line that is not horizontal, as horizontal lines have a slope of zero). Given that the locations 642 have a z coordinate in addition to x and y coordinates, higher-order spherical basis functions may be required to correctly represent this soundfield 640 (as these higher-order spherical basis functions describe the upper and lower or non-horizontal portions of the soundfield. Rather than reduce the soundfield 640 directly to SHCs 511A, the audio encoding device 570 may rotate the soundfield 640 until the line 644 connecting the locations 642 is horizontal.

FIG. 11B is a diagram illustrating the soundfield 640 after being rotated until the line 644 connecting the locations 642 is horizontal. As a result of rotating the soundfield 640 in this manner, the SHC 511A may be derived such that higher-order ones of SHC 511A are specified as zeroes given that the rotated soundfield 640 no longer has any locations of pressure (or energy) with z coordinates. In this way, the audio encoding device 570 may rotate, translate or more generally adjust the soundfield 640 to reduce the number of SHC 511A having non-zero values. In conjunction with various other aspects of the techniques, the audio encoding device 570 may then, rather than signal a 32-bit signed number identifying that these higher order ones of SHC 511A have zero values, signal in a field of the bitstream 517 that these higher order ones of SHC 511A are not signaled. The audio encoding device 570 may also specify rotation information in the bitstream 517 indicating how the soundfield 640 was rotated, often by way of expressing an azimuth and elevation in the manner described above. An extraction device, such as the audio encoding device, may then imply that these non-signaled ones of SHC 511A have a zero value and, when reproducing the soundfield 640 based on SHC 511A, perform the rotation to rotate the soundfield 640 so that the soundfield 640 resembles soundfield 640 shown in the example of FIG. 11A. In this way, the audio encoding device 570 may reduce the number of SHC 511A required to be specified in the bitstream 517 in accordance with the techniques described in this disclosure.

A 'spatial compaction' algorithm may be used to determine the optimal rotation of the soundfield. In one embodiment, audio encoding device 570 may perform the algorithm to iterate through all of the possible azimuth and elevation combinations (i.e., 1024×512 combinations in the above example), rotating the soundfield for each combination, and calculating the number of SHC 511A that are above the threshold value. The azimuth/elevation candidate combination which produces the least number of SHC 511A above the threshold value may be considered to be what may be referred to as the "optimum rotation." In this rotated form, the soundfield may require the least number of SHC 511A for representing the soundfield and can may then be considered compacted. In some instances, the adjustment may comprise this optimal rotation and the adjustment information described above may include this rotation (which may be termed "optimal rotation") information (in terms of the azimuth and elevation angles).

In some instances, rather than only specify the azimuth angle and the elevation angle, the audio encoding device 570 may specify additional angles in the form, as one example, of Euler angles. Euler angles specify the angle of rotation about the z-axis, the former x-axis and the former z-axis. While described in this disclosure with respect to combinations of azimuth and elevation angles, the techniques of this disclosure should not be limited to specifying only the azimuth and elevation angles, but may include specifying any number of angles, including the three Euler angles noted above. In this sense, the audio encoding device 570 may rotate the soundfield to reduce a number of the plurality of hierarchical elements that provide information relevant in describing the soundfield and specify Euler angles as rotation information in the bitstream. The Euler angles, as noted above, may describe how the soundfield was rotated. When using Euler angles, the bitstream extraction device may parse the bitstream to determine rotation information that includes the Euler angles and, when reproducing the soundfield based on those of the plurality of hierarchical elements that provide information relevant in describing the soundfield, rotating the soundfield based on the Euler angles.

Moreover, in some instances, rather than explicitly specify these angles in the bitstream 517, the audio encoding device 570 may specify an index (which may be referred to as a "rotation index") associated with pre-defined combinations of the one or more angles specifying the rotation. In other words, the rotation information may, in some instances, include the rotation index. In these instances, a given value of the rotation index, such as a value of zero, may indicate that no rotation was performed. This rotation index may be used in relation to a rotation table. That is, the audio encoding device 570 may include a rotation table comprising an entry for each of the combinations of the azimuth angle and the elevation angle.

Alternatively, the rotation table may include an entry for each matrix transforms representative of each combination of the azimuth angle and the elevation angle. That is, the audio encoding device 570 may store a rotation table having an entry for each matrix transformation for rotating the soundfield by each of the combinations of azimuth and elevation angles. Typically, the audio encoding device 570 receives SHC 511A and derives SHC 511A', when rotation is performed, according to the following equation:

$$\begin{bmatrix} SHC \\ 511A' \end{bmatrix} = \begin{bmatrix} EncMat_2 \\ (25\times 32) \end{bmatrix} \begin{bmatrix} IncMat_1 \\ (32\times 25) \end{bmatrix} \begin{bmatrix} SHC \\ 511A \end{bmatrix}$$

In the equation above, SHC 511A' are computed as a function of an encoding matrix for encoding a soundfield in terms of a second frame of reference ($EncMat_2$), an inversion matrix for reverting SHC 511A back to a soundfield in terms of a first frame of reference ($InvMat_1$), and SHC 511A. $EncMat_2$ is of size 25×32, while $InvMat_2$ is of size 32×25. Both of SHC 511A' and SHC 511A are of size 25, where SHC 511A' may be further reduced due to removal of those that do not specify salient audio information. $EncMat_2$ may vary for each azimuth and elevation angle combination, while $InvMat_1$ may remain static with respect to each azimuth and elevation angle combination. The rotation table may include an entry storing the result of multiplying each different $EncMat_2$ to $InvMat_1$.

Figure 12:
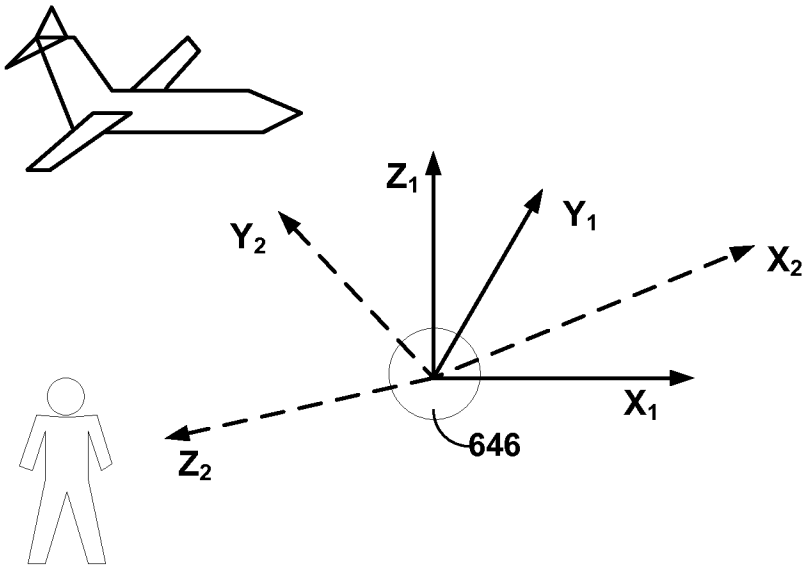
FIG. 12 is a diagram illustrating an example soundfield captured according to a first frame of reference that is then rotated in accordance with the techniques described in this disclosure to express the soundfield in terms of a second frame of reference.

FIG. 12 is a diagram illustrating an example soundfield captured according to a first frame of reference that is then rotated in accordance with the techniques described in this disclosure to express the soundfield in terms of a second frame of reference. In the example of FIG. 12, the soundfield surrounding an Eigen-microphone 646 is captured assuming a first frame of reference, which is denoted by the $X_1$, $Y_1$, and $Z_1$ axes in the example of FIG. 12. SHC 511A describe the soundfield in terms of this first frame of reference. The $InvMat_1$ transforms SHC 511A back to the soundfield, enabling the soundfield to be rotated to the second frame of reference denoted by the $X_2$, $Y_2$, and $Z_2$ axes in the example of FIG. 12. The $EncMat_2$ described above may rotate the soundfield and generate SHC 511A' describing this rotated soundfield in terms of the second frame of reference.

In any event, the above equation may be derived as follows. Given that the soundfield is recorded with a certain coordinate system, such that the front is considered the direction of the x-axis, the 32 microphone positions of an Eigen microphone (or other microphone configurations) are defined from this reference coordinate system. Rotation of the soundfield may then be considered as a rotation of this frame of reference. For the assumed frame of reference, SHC 511A may be calculated as follows:

$$\begin{bmatrix} SHC \\ 511A \end{bmatrix} = \begin{bmatrix} Y_0^0(Pos_1) & Y_0^0(Pos_2) & \dots & Y_0^0(Pos_{32}) \\ Y_1^{-1}(Pos_1) & \vdots & & Y_1^{-1}(Pos_{32}) \\ \vdots & & \ddots & \vdots \\ Y_4^4(Pos_1) & & \dots & Y_4^4(Pos_{32}) \end{bmatrix} \begin{bmatrix} mic_1(t) \\ mic_2(t) \\ \vdots \\ mic_{32}(t) \end{bmatrix}$$

In the above equation, the $Y_n^m$ represent the spherical basis functions at the position (Pas) of the $i^{th}$ microphone (where i may be 1-32 in this example). The $mic_i$ vector denotes the microphone signal for the $i^{th}$ microphone for a time t. The positions (Pas) refer to the position of the microphone in the first frame of reference (i.e., the frame of reference prior to rotation in this example).

The above equation may be expressed alternatively in terms of the mathematical expressions denoted above as:

$$[\text{SHC } 511A]=[E_s(\theta,\phi)][\text{mic}_i(t)].$$

To rotate the soundfield (or in the second frame of reference), the position (Pas) would be calculated in the second frame of reference. As long as the original microphone signals are present, the soundfield may be arbitrarily rotated. However, the original microphone signals ($mic_i(t)$) are often not available. The problem then may be how to retrieve the microphone signals ($mic_i(t)$) from SHC 511A. If a T-design is used (as in a 32 microphone Eigen microphone), the solution to this problem may be achieved by solving the following equation:

$$\begin{bmatrix} mic_1(t) \\ mic_2(t) \\ \vdots \\ mic_{32}(t) \end{bmatrix} = [InvMat_1][SHC511A]$$

This $InvMat_1$ may specify the spherical harmonic basis functions computed according to the position of the microphones as specified relative to the first frame of reference. This equation may also be expressed as $[mic_i(t)]=[E_s(\theta,\phi)]^{-1}[SHC]$, as noted above.

Once the microphone signals ($mic_i(t)$) are retrieved in accordance with the equation above, the microphone signals ($mic_i(t)$) describing the soundfield may be rotated to compute SHC 511A' corresponding to the second frame of reference, resulting in the following equation:

$$\begin{bmatrix} SHC \\ 511A' \end{bmatrix} = \begin{bmatrix} EncMat_2 \\ (25\times 32) \end{bmatrix} \begin{bmatrix} IncMat_1 \\ (32\times 25) \end{bmatrix} \begin{bmatrix} SHC \\ 511A \end{bmatrix}$$

The $EncMat_2$ specifies the spherical harmonic basis functions from a rotated position ($Pos_i'$). In this way, the $EncMat_2$ may effectively specify a combination of the azimuth and elevation angle. Thus, when the rotation table stores the result of $$\begin{bmatrix} EncMat_2 \\ (25\times 32) \end{bmatrix} \begin{bmatrix} IncMat_1 \\ (32\times 25) \end{bmatrix}$$

for each combination of the azimuth and elevation angles, the rotation table effectively specifies each combination of the azimuth and elevation angles. The above equation may also be expressed as:

$$[\text{SHC } 511A'] = [E_s(\theta_2,\phi_2)][E_s(\theta_1,\phi_1)]^{-1}[\text{SHC } 511],$$

where $\theta_2,\phi_2$ represent a second azimuth angle and a second elevation angle different form the first azimuth angle and elevation angle represented by $\theta_1,\phi_1$. The $\theta_1,\phi_1$ correspond to the first frame of reference while the $\theta_2,\phi_2$ correspond to the second frame of reference. The $InvMat_1$ may therefore correspond to $[E_s(\theta_1,\phi_1)]^{-1}$, while the $EncMat_2$ may correspond to $[E_s(\theta_2,\phi_2)]$.

The above may represent a more simplified version of the computation that does not consider the filtering operation, represented above in various equations denoting the derivation of SHC 511A in the frequency domain by the $j_n(\bullet)$ function, which refers to the spherical Bessel function of order n. In the time domain, this $j_n(\bullet)$ function represents a filtering operations that is specific to a particular order, n. With filtering, rotation may be performed per order. To illustrate, consider the following equations:

$$a_n^k(t)\square b_n(t)*\langle [Y_n^m]\square[m_i(t)]\rangle$$

$$a_n^k(t)\square\langle [Y_n^m]\square b_n(t)*[m_i(t)]\rangle$$

From these equations, the rotated SHC 511A' for orders are done separately since the $b_n(t)$ are different for each order. As a result, the above equation may be altered as follows for computing the first order ones of the rotated SHC 511A':

$$\begin{bmatrix} 1^{st} \\ \text{Order} \\ SHC \\ 511A' \end{bmatrix} = \begin{bmatrix} EncMat_2 \\ (25\times 32) \end{bmatrix} \begin{bmatrix} IncMat_1 \\ (32\times 25) \end{bmatrix} \begin{bmatrix} 1^{st} \\ \text{Order} \\ SHC \\ 511A \end{bmatrix}$$

Given that there are three first order ones of SHC 511A, each of the SHC 511A' and 511A vectors are of size three in the above equation. Likewise, for the second order, the following equation may be applied:

$$\begin{bmatrix} 2^{nd} \\ \text{Order} \\ SHC \\ 511A' \end{bmatrix} = \begin{bmatrix} EncMat_2 \\ (25\times 32) \end{bmatrix} \begin{bmatrix} IncMat_1 \\ (32\times 25) \end{bmatrix} \begin{bmatrix} 2^{nd} \\ \text{Order} \\ SHC \\ 511A \end{bmatrix}$$

Again, given that there are five second order ones of SHC 511A, each of the SHC 511A' and 511A vectors are of size five in the above equation. The remaining equations for the other orders, i.e., the third and fourth orders, may be similar to that described above, following the same pattern with regard to the sizes of the matrixes (in that the number of rows of $EncMat_2$, the number of columns of $InvMat_1$ and the sizes of the third and forth order SHC 511A and SHC 511A' vectors is equal to the number of sub-orders (m times two plus 1) of each of the third and fourth order spherical harmonic basis functions.

The audio encoding device 570 may therefore perform this rotation operation with respect to every combination of azimuth and elevation angle in an attempt to identify the so-called optimal rotation. The audio encoding device 570 may, after performing this rotation operation, compute the number of SHC 511A' above the threshold value. In some instances, the audio encoding device 570 may perform this rotation to derive a series of SHC 511A' that represent the soundfield over a duration of time, such as an audio frame. By performing this rotation to derive the series of the SHC 511A' that represent the soundfield over this time duration, the audio encoding device 570 may reduce the number of rotation operations that have to be performed in comparison for doing this for each set of the SHC 511A describing the soundfield for time durations less than a frame or other length. In any event, the audio encoding device 570 may save, throughout this process, those of SHC 511A' having the least number of the SHC 511A' greater than the threshold value.

However, performing this rotation operation with respect to every combination of azimuth and elevation angle may be processor intensive or time-consuming. As a result, the audio encoding device 570 may not perform what may be characterized as this "brute force" implementation of the rotation algorithm. Instead, the audio encoding device 570 may perform rotations with respect to a subset of possibly known (statistically-wise) combinations of azimuth and elevation angle that offer generally good compaction, performing further rotations with regard to combinations around those of this subset providing better compaction compared to other combinations in the subset.

As another alternative, the audio encoding device 570 may perform this rotation with respect to only the known subset of combinations. As another alternative, the audio encoding device 570 may follow a trajectory (spatially) of combinations, performing the rotations with respect to this trajectory of combinations. As another alternative, the audio encoding device 570 may specify a compaction threshold that defines a maximum number of SHC 511A' having non-zero values above the threshold value. This compaction threshold may effectively set a stopping point to the search, such that, when the audio encoding device 570 performs a rotation and determines that the number of SHC 511A' having a value above the set threshold is less than or equal to (or less than in some instances) than the compaction threshold, the audio encoding device 570 stops performing any additional rotation operations with respect to remaining combinations. As yet another alternative, the audio encoding device 570 may traverse a hierarchically arranged tree (or other data structure) of combinations, performing the rotation operations with respect to the current combination and traversing the tree to the right or left (e.g., for binary trees) depending on the number of SHC 511A' having a non-zero value greater than the threshold value.

In this sense, each of these alternatives involve performing a first and second rotation operation and comparing the result of performing the first and second rotation operation to identify one of the first and second rotation operations that results in the least number of the SHC 511A' having a non-zero value greater than the threshold value. Accordingly, the audio encoding device 570 may perform a first rotation operation on the soundfield to rotate the soundfield in accordance with a first azimuth angle and a first elevation angle and determine a first number of the plurality of hierarchical elements representative of the soundfield rotated in accordance with the first azimuth angle and the first elevation angle that provide information relevant in describing the soundfield. The audio encoding device 570 may also perform a second rotation operation on the soundfield to rotate the soundfield in accordance with a second azimuth angle and a second elevation angle and determine a second number of the plurality of hierarchical elements representative of the soundfield rotated in accordance with the second azimuth angle and the second elevation angle that provide information relevant in describing the soundfield. Furthermore, the audio encoding device 570 may select the first rotation operation or the second rotation operation based on a comparison of the first number of the plurality of hierarchical elements and the second number of the plurality of hierarchical elements.

In some instances, the rotation algorithm may be performed with respect to a duration of time, where subsequent invocations of the rotation algorithm may perform rotation operations based on past invocations of the rotation algorithm. In other words, the rotation algorithm may be adaptive based on past rotation information determined when rotating the soundfield for a previous duration of time. For example, the audio encoding device 570 may rotate the soundfield for a first duration of time, e.g., an audio frame, to identify SHC 511A' for this first duration of time. The audio encoding device 570 may specify the rotation information and the SHC 511A' in the bitstream 517 in any of the ways described above. This rotation information may be referred to as first rotation information in that it describes the rotation of the soundfield for the first duration of time. The audio encoding device 570 may then, based on this first rotation information, rotate the soundfield for a second duration of time, e.g., a second audio frame, to identify SHC 511A' for this second duration of time. The audio encoding device 570 may utilize this first rotation information when performing the second rotation operation over the second duration of time to initialize a search for the "optimal" combination of azimuth and elevation angles, as one example. The audio encoding device 570 may then specify the SHC 511A' and corresponding rotation information for the second duration of time (which may be referred to as "second rotation information") in the bitstream 517.

While described above with respect to a number of different ways by which to implement the rotation algorithm to reduce processing time and/or consumption, the techniques may be performed with respect to any algorithm that may reduce or otherwise speed the identification of what may be referred to as the "optimal rotation." Moreover, the techniques may be performed with respect to any algorithm that identifying non-optimal rotations but that may improve performance in other aspects, often measured in terms of speed or processor or other resource utilization.

Figure 13A:
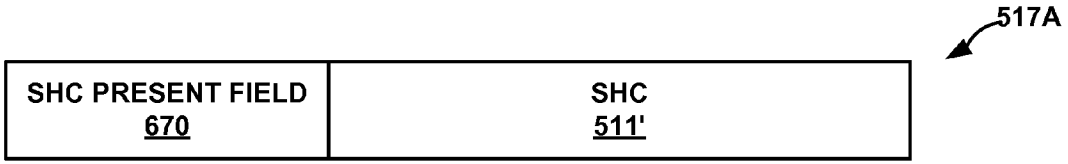
FIGS. 13A-13E are each a diagram illustrating bitstreams formed in accordance with the techniques described in this disclosure.

FIGS. 13A-13E are each a diagram illustrating bitstreams 517A-517E formed in accordance with the techniques described in this disclosure. In the example of FIG. 13A, the bitstream 517A may represent one example of the bitstream 517 shown in FIG. 9 above. The bitstream 517A includes an SHC present field 670 and a field that stores SHC 511A' (where the field is denoted "SHC 511A'"). The SHC present field 670 may include a bit corresponding to each of SHC 511A. The SHC 511A' may represent those of SHC 511A that are specified in the bitstream, which may be less in number than the number of the SHC 511A. Typically, each of SHC 511A' are those of SHC 511A having non-zero values. As noted above, for a fourth-order representation of any given soundfield, $(1+4)^2$ or 25 SHC are required. Eliminating one or more of these SHC and replacing these zero valued SHC with a single bit may save 31 bits, which may be allocated to expressing other portions of the soundfield in more detail or otherwise removed to facilitate efficient bandwidth utilization.

Figure 13B:
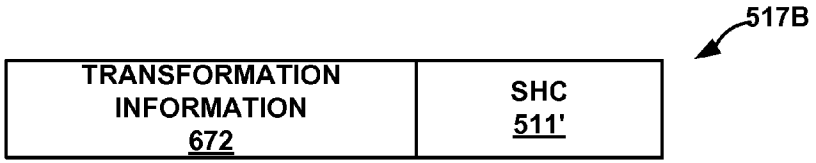

In the example of FIG. 13B, the bitstream 517B may represent one example of the bitstream 517 shown in FIG. 9 above. The bitstream 517B includes an transformation information field 672 ("transformation information 672") and a field that stores SHC 511A' (where the field is denoted "SHC 511A'"). The transformation information 672, as noted above, may comprise translation information, rotation information, and/or any other form of information denoting an adjustment to a soundfield. In some instances, the transformation information 672 may also specify a highest order of SHC 511A that are specified in the bitstream 517B as SHC 511A'. That is, the transformation information 672 may indicate an order of three, which the extraction device may understand as indicating that SHC 511A' includes those of SHC 511A up to and including those of SHC 511A having an order of three. The extraction device may then be configured to set SHC 511A having an order of four or higher to zero, thereby potentially removing the explicit signaling of SHC 511A of order four or higher in the bitstream.

Figure 13C:
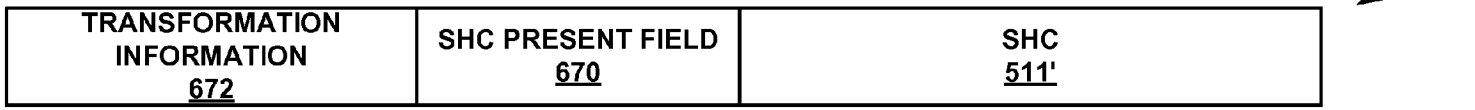

In the example of FIG. 13C, the bitstream 517C may represent one example of the bitstream 517 shown in FIG. 9 above. The bitstream 517C includes the transformation information field 672 ("transformation information 672"), the SHC present field 670 and a field that stores SHC 511A' (where the field is denoted "SHC 511A"). Rather than be configured to understand which order of SHC 511A are not signaled as described above with respect to FIG. 13B, the SHC present field 670 may explicitly signal which of the SHC 511A are specified in the bitstream 517C as SHC 511A'.

Figure 13D:
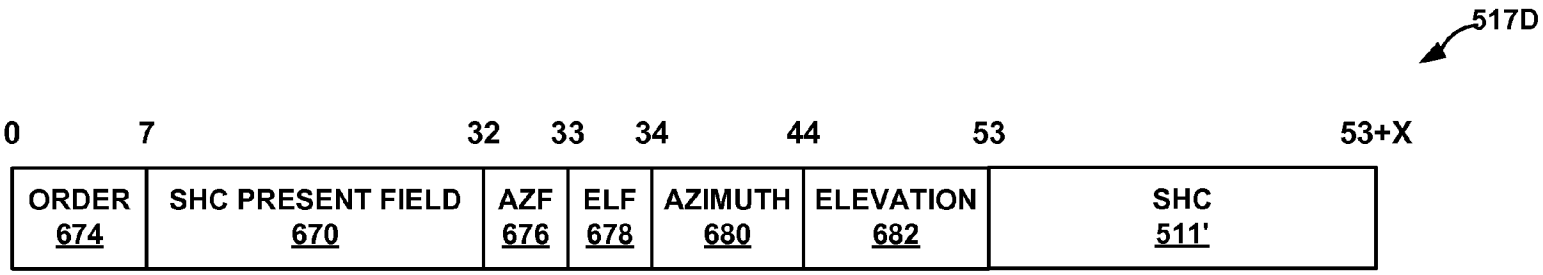

In the example of FIG. 13D, the bitstream 517D may represent one example of the bitstream 517 shown in FIG. 9 above. The bitstream 517D includes an order field 674 ("order 60"), the SHC present field 670, an azimuth flag 676 ("AZF 676"), an elevation flag 678 ("ELF 678"), an azimuth angle field 680 ("azimuth 680"), an elevation angle field 682 ("elevation 682") and a field that stores SHC 511A' (where, again, the field is denoted "SHC 511A'"). The order field 674 specifies the order of SHC 511A', i.e., the order denoted by n above for the highest order of the spherical basis function used to represent the soundfield. The order field 674 is shown as being an 8-bit field, but may be of other various bit sizes, such as three (which is the number of bits required to specify the forth order). The SHC present field 670 is shown as a 25-bit field. Again, however, the SHC present field 670 may be of other various bit sizes. The SHC present field 670 is shown as 25 bits to indicate that the SHC present field 670 may include one bit for each of the spherical harmonic coefficients corresponding to a fourth order representation of the soundfield.

The azimuth flag 676 represents a one-bit flag that specifies whether the azimuth field 680 is present in the bitstream 517D. When the azimuth flag 676 is set to one, the azimuth field 680 for SHC 511A' is present in the bitstream 517D. When the azimuth flag 676 is set to zero, the azimuth field 680 for SHC 511A' is not present or otherwise specified in the bitstream 517D. Likewise, the elevation flag 678 represents a one-bit flag that specifies whether the elevation field 682 is present in the bitstream 517D. When the elevation flag 678 is set to one, the elevation field 682 for SHC 511A' is present in the bitstream 517D. When the elevation flag 678 is set to zero, the elevation field 682 for SHC 511A' is not present or otherwise specified in the bitstream 517D. While described as one signaling that the corresponding field is present and zero signaling that the corresponding field is not present, the convention may be reversed such that a zero specifies that the corresponding field is specified in the bitstream 517D and a one specifies that the corresponding field is not specified in the bitstream 517D. The techniques described in this disclosure should therefore not be limited in this respect.

The azimuth field 680 represents a 10-bit field that specifies, when present in the bitstream 517D, the azimuth angle. While shown as a 10-bit field, the azimuth field 680 may be of other bit sizes. The elevation field 682 represents a 9-bit field that specifies, when present in the bitstream 517D, the elevation angle. The azimuth angle and the elevation angle specified in fields 680 and 682, respectively, may in conjunction with the flags 676 and 678 represent the rotation information described above. This rotation information may be used to rotate the soundfield so as to recover SHC 511A in the original frame of reference.

The SHC 511A' field is shown as a variable field that is of size X. The SHC 511A' field may vary due to the number of SHC 511A' specified in the bitstream as denoted by the SHC present field 670. The size X may be derived as a function of the number of ones in SHC present field 670 times 32-bits (which is the size of each SHC 511A').

Figure 13E:
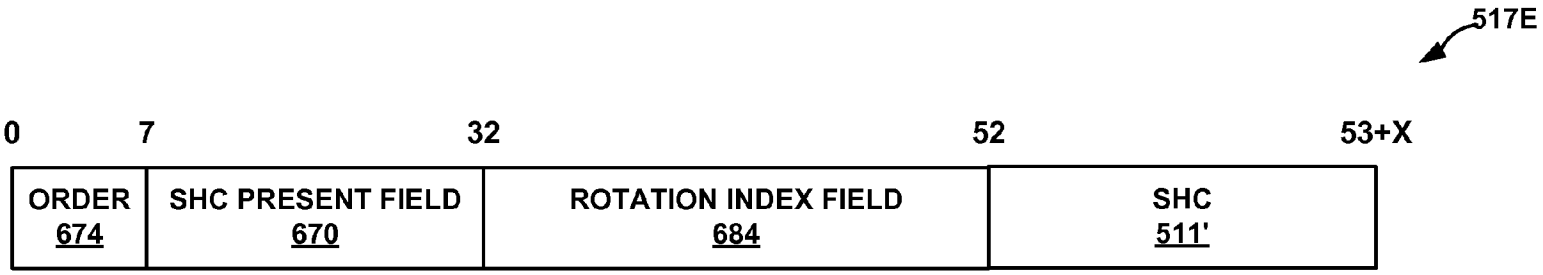

In the example of FIG. 13E, the bitstream 517E may represent another example of the bitstream 517 shown in FIG. 9 above. The bitstream 517E includes an order field 674 ("order 60"), an SHC present field 670, and a rotation index field 684, and a field that stores SHC 511A' (where, again, the field is denoted "SHC 511A'"). The order field 674, the SHC present field 670 and the SHC 511A' field may be substantially similar to those described above. The rotation index field 684 may represent a 20-bit field used to specify one of the 1024×512 (or, in other words, 524288) combinations of the elevation and azimuth angles. In some instances, only 19-bits may be used to specify this rotation index field 684, and the audio encoding device 570 may specify an additional flag in the bitstream to indicate whether a rotation operation was performed (and, therefore, whether the rotation index field 684 is present in the bitstream). This rotation index field 684 specifies the rotation index noted above, which may refer to an entry in a rotation table common to both the audio encoding device 570 and the bitstream extraction device. This rotation table may, in some instances, store the different combinations of the azimuth and elevation angles. Alternatively, the rotation table may store the matrix described above, which effectively stores the different combinations of the azimuth and elevation angles in matrix form.

Figure 14:
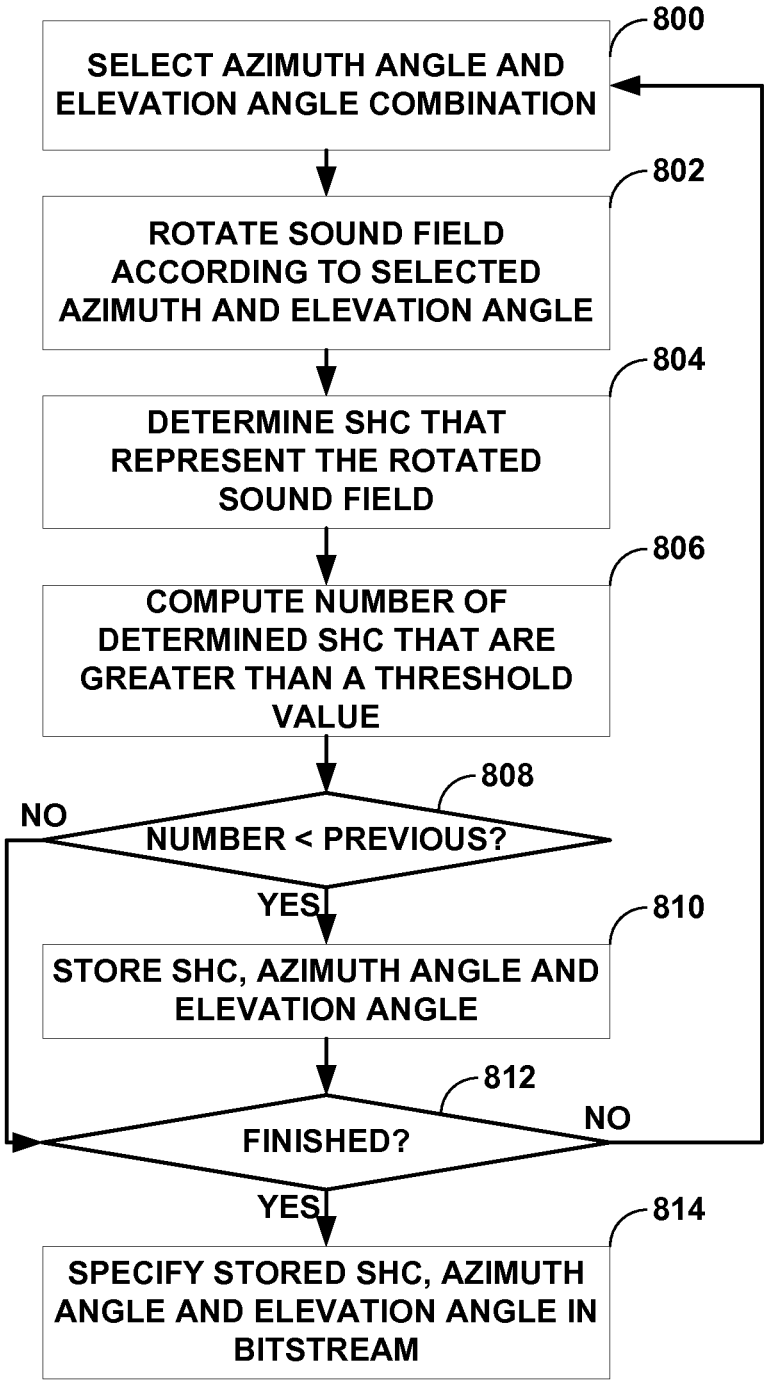
FIG. 14 is a flowchart illustrating example operation of the audio encoding device shown in the example of FIG. 9 in implementing the rotation aspects of the techniques described in this disclosure.

FIG. 14 is a flowchart illustrating example operation of the audio encoding device 570 shown in the example of FIG. 9 in implementing the rotation aspects of the techniques described in this disclosure. Initially, the audio encoding device 570 may select an azimuth angle and elevation angle combination in accordance with one or more of the various rotation algorithms described above (800). The audio encoding device 570 may then rotate the soundfield according to the selected azimuth and elevation angle (802). As described above, the audio encoding device 570 may first derive the soundfield from SHC 511A using the $InvMat_1$ noted above. The audio encoding device 570 may also determine SHC 511A' that represent the rotated soundfield (804). While described as being separate steps or operations, the audio encoding device 570 may apply a transform (which may represent the result of $[EncMat_2][InvMat_1]$) that represents the selection of the azimuth angle and the elevation angle combination, deriving the soundfield from the SHC 511A, rotating the soundfield and determining the SHC 511A' that represent the rotated soundfield.

In any event, the audio encoding device 570 may then compute a number of the determined SHC 511A' that are greater than a threshold value, comparing this number to a number computed for a previous iteration with respect to a previous azimuth angle and elevation angle combination (806, 808). In the first iteration with respect to the first azimuth angle and elevation angle combination, this comparison may be to a predefined previous number (which may set to zero). In any event, if the determined number of the SHC 511A' is less than the previous number ("YES" 808), the audio encoding device 570 stores the SHC 511A', the azimuth angle and the elevation angle, often replacing the previous SHC 511A', azimuth angle and elevation angle stored from a previous iteration of the rotation algorithm (810).

If the determined number of the SHC 511A' is not less than the previous number ("NO" 808) or after storing the SHC 511A', azimuth angle and elevation angle in place of the previously stored SHC 511A', azimuth angle and elevation angle, the audio encoding device 570 may determine whether the rotation algorithm has finished (812). That is, the audio encoding device 570 may, as one example, determine whether all available combination of azimuth angle and elevation angle have been evaluated. In other examples, the audio encoding device 570 may determine whether other criteria are met (such as that all of a defined subset of combination have been performed, whether a given trajectory has been traversed, whether a hierarchical tree has been traversed to a leaf node, etc.) such that the audio encoding device 570 has finished performing the rotation algorithm. If not finished ("NO" 812), the audio encoding device 570 may perform the above process with respect to another selected combination (800-812). If finished ("YES" 812), the audio encoding device 570 may specify the stored SHC 511A', azimuth angle and elevation angle in the bitstream 517 in one of the various ways described above (814).

Figure 15:
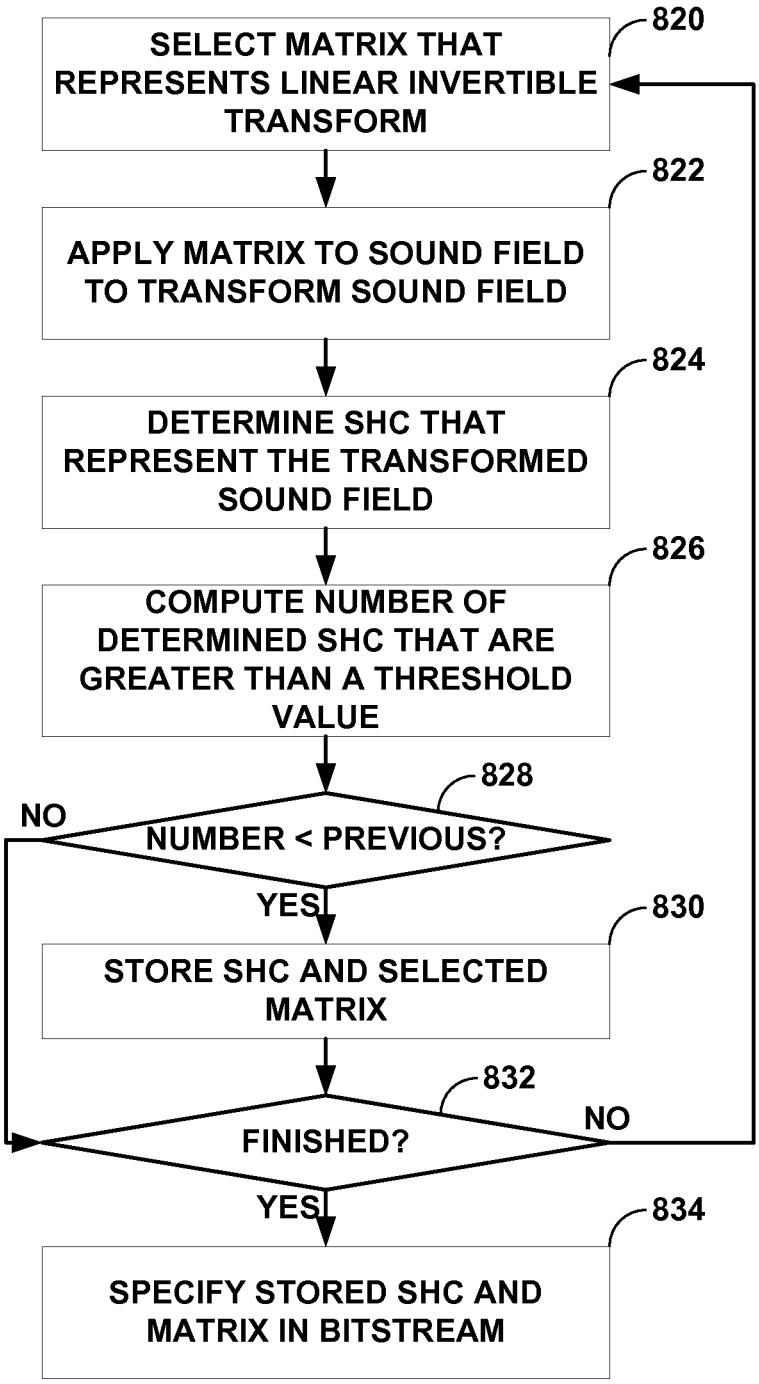
FIG. 15 is a flowchart illustrating example operation of the audio encoding device shown in the example of FIG. 9 in performing the transformation aspects of the techniques described in this disclosure.

FIG. 15 is a flowchart illustrating example operation of the audio encoding device 570 shown in the example of FIG. 9 in performing the transformation aspects of the techniques described in this disclosure. Initially, the audio encoding device 570 may select a matrix that represents a linear invertible transform (820). One example of a matrix that represents a linear invertible transform may be the above shown matrix that is the result of $[EncMat_2][IncMat_1]$. The audio encoding device 570 may then apply the matrix to the soundfield to transform the soundfield (822). The audio encoding device 570 may also determine SHC 511A' that represent the rotated soundfield (824). While described as being separate steps or operations, the audio encoding device 570 may apply a transform (which may represent the result of $[EncMat_2][InvMat_1]$), deriving the soundfield from the SHC 511A, transform the soundfield and determining the SHC 511A' that represent the transform soundfield.

In any event, the audio encoding device 570 may then compute a number of the determined SHC 511A' that are greater than a threshold value, comparing this number to a number computed for a previous iteration with respect to a previous application of a transform matrix (826, 828). If the determined number of the SHC 511A' is less than the previous number ("YES" 828), the audio encoding device 570 stores the SHC 511A' and the matrix (or some derivative thereof, such as an index associated with the matrix), often replacing the previous SHC 511A' and matrix (or derivative thereof) stored from a previous iteration of the rotation algorithm (830).

If the determined number of the SHC 511A' is not less than the previous number ("NO" 828) or after storing the SHC 511A' and matrix in place of the previously stored SHC 511A' and matrix, the audio encoding device 570 may determine whether the transform algorithm has finished (832). That is, the audio encoding device 570 may, as one example, determine whether all available transform matrixes have been evaluated. In other examples, the audio encoding device 570 may determine whether other criteria are met (such as that all of a defined subset of the available transform matrixes have been performed, whether a given trajectory has been traversed, whether a hierarchical tree has been traversed to a leaf node, etc.) such that the audio encoding device 570 has finished performing the transform algorithm. If not finished ("NO" 832), the audio encoding device 570 may perform the above process with respect to another selected transform matrix (820-832). If finished ("YES" 832), the audio encoding device 570 may specify the stored SHC 511A' and the matrix in the bitstream 517 in one of the various ways described above (834).

In some examples, the transform algorithm may perform a single iteration, evaluating a single transform matrix. That is, the transform matrix may comprise any matrix that represents a linear invertible transform. In some instances, the linear invertible transform may transform the soundfield from the spatial domain to the frequency domain. Examples of such a linear invertible transform may include a discrete Fourier transform (DFT). Application of the DFT may only involve a single iteration and therefore would not necessarily include steps to determine whether the transform algorithm is finished. Accordingly, the techniques should not be limited to the example of FIG. 15.

In other words, one example of a linear invertible transform is a discrete Fourier transform (DFT). The twenty-five SHC 511A' could be operated on by the DFT to form a set of twenty-five complex coefficients. The audio encoding device 570 may also zero-pad The twenty five SHCs 511A' to be an integer multiple of 2, so as to potentially increase the resolution of the bin size of the DFT, and potentially have a more efficient implementation of the DFT, e.g. through applying a fast Fourier transform (FFT). In some instances, increasing the resolution of the DFT beyond 25 points is not necessarily required. In the transform domain, the audio encoding device 570 may apply a threshold to determine whether there is any spectral energy in a particular bin. The audio encoding device 570, in this context, may then discard or zero-out spectral coefficient energy that is below this threshold, and the audio encoding device 570 may apply an inverse transform to recover SHC 511A' having one or more of the SHC 511A' discarded or zeroed-out. That is, after the inverse transform is applied, the coefficients below the threshold are not present, and as a result, less bits may be used to encode the soundfield.

It should be understood that, depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially. In addition, while certain aspects of this disclosure are described as being performed by a single device, module or unit for purposes of clarity, it should be understood that the techniques of this disclosure may be performed by a combination of devices, units or modules.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol.

In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium.

It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

In addition to or as an alternative to the above, the following examples are described. The features described in any of the following examples may be utilized with any of the other examples described herein.

One example is directed to a method of binaural audio rendering comprising obtaining transformation information, the transformation information describing how a sound field was transformed to reduce a number of a plurality of hierarchical elements; and performing the binaural audio rendering with respect to the reduced number of the plurality of hierarchical elements based on the determined transformation information.

In some examples, performing the binaural audio rendering comprises transforming a frame of reference by which to render the reduced plurality of hierarchical elements to a plurality of channels based on the determined transformation information.

In some examples, the transformation information comprises rotation information that specifies at least an elevation angle and an azimuth angle by which the sound field was rotated.

In some examples, the transformation information comprises rotation information that specifies one or more angles, each of which is specified relative to an x-axis and a y-axis, an x-axis and a z-axis, or a y-axis and a z-axis by which the sound field was rotated, and performing the binaural audio rendering comprises rotating a frame of reference by which a rendering function is to render the reduced plurality of hierarchical elements based on the determined rotation information.

In some examples, performing the binaural audio rendering comprises transforming a frame of reference by which a rendering function is to render the reduced plurality of hierarchical elements based on the determined transformation information; and applying an energy preservation function with respect to the transformed rendering function.

In some examples, performing the binaural audio rendering comprises transforming a frame of reference by which a rendering function is to render the reduced plurality of hierarchical elements based on the determined transformation information; and combining the transformed rendering function with a complex binaural room impulse response function using multiplication operations.

In some examples, performing the binaural audio rendering comprises transforming a frame of reference by which a rendering function is to render the reduced plurality of hierarchical elements based on the determined transformation information; and combining the transformed rendering function with a complex binaural room impulse response function using multiplication operations and without requiring convolution operations.

In some examples, performing the binaural audio rendering comprises transforming a frame of reference by which a rendering function is to render the reduced plurality of hierarchical elements based on the determined transformation information; combining the transformed rendering function with a complex binaural room impulse response function to generate a rotated binaural audio rendering function; and applying the rotated binaural audio rendering function to the reduced plurality of hierarchical elements to generate left and right channels.

In some examples, the plurality of hierarchical elements comprise a plurality of spherical harmonic coefficients of which at least one of the plurality of spherical harmonic coefficients are associated with an order greater than one.

In some examples, the method also comprises retrieving a bitstream that includes encoded audio data and the transformation information; parsing the encoded audio data from the bitstream; and decoding the parsed encoded audio data to generate the reduced plurality of spherical harmonic coefficients, and determining the transformation information comprises parsing the transformation information from the bitstream.

In some examples, the method also comprises retrieving a bitstream that includes encoded audio data and the transformation information; parsing the encoded audio data from the bitstream; and decoding the parsed encoded audio data in accordance with an advanced audio coding (AAC) scheme to generate the reduced plurality of spherical harmonic coefficients, and determining the transformation information comprises parsing the transformation information from the bitstream.

In some examples, the method also comprises retrieving a bitstream that includes encoded audio data and the transformation information; parsing the encoded audio data from the bitstream; and decoding the parsed encoded audio data in accordance with an unified speech and audio coding (USAC) scheme to generate the reduced plurality of spherical harmonic coefficients, and determining the transformation information comprises parsing the transformation information from the bitstream.

In some examples, the method also comprises determining a position of a head of a listener relative to the sound field represented by the plurality of spherical harmonic coefficients; and determining updated transformation information based on the determined transformation information and the determined position of the head of the listener, and performing the binaural audio rendering comprises performing the binaural audio rendering with respect to the reduced plurality of hierarchical elements based on the updated transformation information.

One example is directed to a device comprises one or more processors configured to determine transformation information, the transformation information describing how a sound field was transformed to reduce a number of the plurality of hierarchical elements providing information relevant in describing the sound field, and perform the binaural audio rendering with respect to the reduced plurality of hierarchical elements based on the determined transformation information.

In some examples, the one or more processors are further configured to, when performing the binaural audio rendering, transform a frame of reference by which to render the reduced plurality of hierarchical elements to a plurality of channels based on the determined transformation information.

In some examples, the determined transformation information comprises rotation information that specifies at least an elevation angle and an azimuth angle by which the sound field was rotated.

In some examples, the transformation information comprises rotation information that specifies one or more angles, each of which is specified relative to an x-axis and a y-axis, an x-axis and a z-axis or a y-axis and a z-axis by which the sound field was rotated, and the one or more processors are further configured to, when performing the binaural audio rendering, rotate a frame of reference by which a rendering function is to render the reduced plurality of hierarchical elements based on the determined rotation information.

In some examples, the one or more processors are further configured to, when performing the binaural audio rendering, transform a frame of reference by which a rendering function is to render the reduced plurality of hierarchical elements based on the determined transformation information, and apply an energy preservation function with respect to the transformed rendering function.

In some examples, the one or more processors are further configured to, when performing the binaural audio rendering, transform a frame of reference by which a rendering function is to render the reduced plurality of hierarchical elements based on the determined transformation information, and combine the transformed rendering function with a complex binaural room impulse response function using multiplication operations.

In some examples, the one or more processors are further configured to, when performing the binaural audio rendering, transform a frame of reference by which a rendering function is to render the reduced plurality of hierarchical elements based on the determined transformation information, and combine the transformed rendering function with a complex binaural room impulse response function using multiplication operations and without requiring convolution operations.

In some examples, the one or more processors are further configured to, when performing the binaural audio rendering, transform a frame of reference by which a rendering function is to render the reduced plurality of hierarchical elements based on the determined transformation information, combine the transformed rendering function with a complex binaural room impulse response function to generate a rotated binaural audio rendering function, and apply the rotated binaural audio rendering function to the reduced plurality of hierarchical elements to generate left and right channels.

In some examples, the plurality of hierarchical elements comprise a plurality of spherical harmonic coefficients of which at least one of the plurality of spherical harmonic coefficients is associated with an order greater than one.

In some examples, the one or more processors are further configured to retrieve a bitstream that includes encoded audio data and the transformation information, parse the encoded audio data from the bitstream, and decode the parsed encoded audio data to generate the reduced plurality of spherical harmonic coefficients, and the one or more processors are further configured to, when determining the transformation information, parse the transformation information from the bitstream.

In some examples, the one or more processors are further configured to retrieve a bitstream that includes encoded audio data and the transformation information, parse the encoded audio data from the bitstream, and decode the parsed encoded audio data in accordance with an advanced audio coding (AAC) scheme to generate the reduced plurality of spherical harmonic coefficients, and the one or more processors are further configured to, when determining the transformation information, parse the transformation information from the bitstream.

In some examples, the one or more processors are further configured to retrieve a bitstream that includes encoded audio data and the transformation information, parse the encoded audio data from the bitstream, and decode the parsed encoded audio data in accordance with an unified speech and audio coding (USAC) scheme to generate the reduced plurality of spherical harmonic coefficients, and the one or more processors are further configured to, when determining the transformation information, parse the transformation information from the bitstream.

In some examples, the one or more processors are further configured to determine a position of a head of a listener relative to the sound field represented by the plurality of spherical harmonic coefficients, and determine updated transformation information based on the determined transformation information and the determined position of the head of the listener, and the one or more processors are further configured to, when performing the binaural audio rendering, perform the binaural audio rendering with respect to the reduced plurality of hierarchical elements based on the updated transformation information.

One example is directed to a device comprising means for determining transformation information, the transformation information describing how a sound field was transformed to reduce a number of the plurality of hierarchical elements providing information relevant in describing the sound field; and means for performing the binaural audio rendering with respect to the reduced plurality of hierarchical elements based on the determined transformation information.

In some examples, the means for performing the binaural audio rendering comprises means for transforming a frame of reference by which to render the reduced plurality of hierarchical elements to a plurality of channels based on the determined transformation information.

In some examples, the transformation information comprises rotation information that specifies at least an elevation angle and an azimuth angle by which the sound field was rotated.

In some examples, the transformation information comprises rotation information that specifies one or more angles, each of which is specified relative to an x-axis and a y-axis, an x-axis and a z-axis or a y-axis and a z-axis by which the sound field was rotated, and the means for performing the binaural audio rendering comprises means for rotating a frame of reference by which a rendering function is to render the reduced plurality of hierarchical elements based on the determined rotation information.

In some examples, the means for performing the binaural audio rendering comprises means for transforming a frame of reference by which a rendering function is to render the reduced plurality of hierarchical elements based on the determined transformation information; and means for applying an energy preservation function with respect to the transformed rendering function.

In some examples, the means for performing the binaural audio rendering comprises means for transforming a frame of reference by which a rendering function is to render the reduced plurality of hierarchical elements based on the determined transformation information; and means for combining the transformed rendering function with a complex binaural room impulse response function using multiplication operations.

In some examples, the means for performing the binaural audio rendering comprises means for transforming a frame of reference by which a rendering function is to render the reduced plurality of hierarchical elements based on the determined transformation information; and means for combining the transformed rendering function with a complex binaural room impulse response function using multiplication operations and without requiring convolution operations.

In some examples, the means for performing the binaural audio rendering comprises means for transforming a frame of reference by which a rendering function is to render the reduced plurality of hierarchical elements based on the determined transformation information; means for combining the transformed rendering function with a complex binaural room impulse response function to generate a rotated binaural audio rendering function; and means for applying the rotated binaural audio rendering function to the reduced plurality of hierarchical elements to generate left and right channels.

In some examples, the plurality of hierarchical elements comprise a plurality of spherical harmonic coefficients of which at least one of the plurality of spherical harmonic coefficients is associated with an order greater than one.

In some examples, the device further comprises means for retrieving a bitstream that includes encoded audio data and the transformation information; means for parsing the encoded audio data from the bitstream; and means for decoding the parsed encoded audio data to generate the reduced plurality of spherical harmonic coefficients, and the means for determining the transformation information comprises means for parsing the transformation information from the bitstream.

In some examples, the device further comprises means for retrieving a bitstream that includes encoded audio data and the transformation information; means for parsing the encoded audio data from the bitstream; and means for decoding the parsed encoded audio data in accordance with an advanced audio coding (AAC) scheme to generate the reduced plurality of spherical harmonic coefficients, and the means for determining the transformation information comprises means for parsing the transformation information from the bitstream.

In some examples, the device further comprises means for retrieving a bitstream that includes encoded audio data and the transformation information; means for parsing the encoded audio data from the bitstream; and means for decoding the parsed encoded audio data in accordance with an unified speech and audio coding (USAC) scheme to generate the reduced plurality of spherical harmonic coefficients, and the means for determining the transformation information comprises means for parsing the transformation information from the bitstream.

In some examples, the device further comprises means for determining a position of a head of a listener relative to the sound field represented by the plurality of spherical harmonic coefficients; and means for determining updated transformation information based on the determined transformation information and the determined position of the head of the listener, and the means for performing the binaural audio rendering comprises means for performing the binaural audio rendering with respect to the reduced plurality of hierarchical elements based on the updated transformation information.

One example is directed to a non-transitory computer-readable storage medium having stored thereon instructions that, when executed, cause one or more processors to determine transformation information, the transformation information describing how a sound field was transformed to reduce a number of the plurality of hierarchical elements providing information relevant in describing the sound field; and perform the binaural audio rendering with respect to the reduced plurality of hierarchical elements based on the determined transformation information.

Moreover, any of the specific features set forth in any of the examples described above may be combined into a beneficial embodiment of the described techniques. That is, any of the specific features are generally applicable to all examples of the techniques.

Various embodiments of the techniques have been described. These and other embodiments are within the scope of the following claims.

What is claimed is:

1. A method of binaural audio rendering comprising:

obtaining a bitstream that includes encoded audio data and transformation information;

decoding the encoded audio data to obtain a reduced plurality of hierarchical elements, the transformation information describing how a sound field represented by a plurality of hierarchical elements was transformed in order to generate the reduced plurality of hierarchical elements, the reduced plurality of hierarchical elements having a number of hierarchical elements that is less than a number of the plurality of hierarchical elements; and performing the binaural audio rendering with respect to the reduced plurality of hierarchical elements based on the transformation information.

2. The method of claim 1, wherein performing the binaural audio rendering comprises transforming a frame of reference by which to render the reduced plurality of hierarchical elements to a plurality of channels based on the transformation information.

3. The method of claim 1, the transformation information comprising rotation information that specifies at least an elevation angle and an azimuth angle by which the sound field was transformed.

4. The method of claim 1, wherein performing the binaural audio rendering comprises:

transforming a frame of reference by which a rendering function is to render the reduced plurality of hierarchical elements based on the transformation information; and applying an energy preservation function with respect to the transformed rendering function.

5. The method of claim 1, wherein performing the binaural audio rendering comprises:

transforming a rendering function by transforming a frame of reference by which the rendering function is to render the reduced plurality of hierarchical elements based on the transformation information; and combining the transformed rendering function with a complex binaural room impulse response function using multiplication operations.

6. The method of claim 1, wherein performing the binaural audio rendering comprises:

transforming a rendering function by transforming a frame of reference by which the rendering function is to render the reduced plurality of hierarchical elements based on the transformation information; and combining the transformed rendering function with a complex binaural room impulse response function using multiplication operations and without requiring convolution operations.

7. The method of claim 1, wherein performing the binaural audio rendering comprises:

transforming a rendering function by transforming a frame of reference by which a rendering function is to render the reduced plurality of hierarchical elements based on the transformation information;

combining the transformed rendering function with a complex binaural room impulse response function to generate a rotated binaural audio rendering function; and applying the rotated binaural audio rendering function to the reduced plurality of hierarchical elements to generate left and right channels.

8. The method of claim 1, the plurality of hierarchical elements comprising a plurality of spherical harmonic coefficients of which at least one of the plurality of spherical harmonic coefficients are associated with an order greater than one.

9. The method of claim 1, further comprising:

parsing the encoded audio data from the bitstream to obtain parsed encoded audio data;

decoding the parsed encoded audio data to obtain the reduced plurality of hierarchical elements; and parsing the transformation information from the bitstream.

10. The method of claim 1, further comprising:

obtaining a position of a head of a listener relative to the sound field represented by the plurality of hierarchical elements; and determining updated transformation information based on the transformation information and the position of the head of the listener, wherein performing the binaural audio rendering comprises performing the binaural audio rendering with respect to the reduced plurality of hierarchical elements based on the updated transformation information.

11. A device comprising one or more processors, the one or more processors configured to:

obtain a bitstream that includes encoded audio data and transformation information, decode the encoded audio data to obtain a reduced plurality of hierarchical elements, the transformation information describing how a sound field represented by a plurality of hierarchical elements was transformed in order to generate the reduced plurality of hierarchical elements, the reduced plurality of hierarchical elements having a number of hierarchical elements that is less than a number of the plurality of hierarchical elements; and perform binaural audio rendering with respect to the reduced plurality of hierarchical elements based on the transformation information.

12. The device of claim 11, wherein to perform the binaural audio rendering, the one or more processors are further configured to transform a frame of reference by which to render the reduced plurality of hierarchical elements to a plurality of channels based on the transformation information.

13. The device of claim 11, the transformation information comprising rotation information that specifies at least an elevation angle and an azimuth angle by which the sound field was transformed.

14. The device of claim 11, wherein to perform the binaural audio rendering, the one or more processors are further configured to transform a frame of reference by which a rendering function is to render the reduced plurality of hierarchical elements based on the transformation information, and apply an energy preservation function with respect to the transformed rendering function.

15. The device of claim 11, wherein to perform the binaural audio rendering, the one or more processors are further configured to transform a rendering function by transforming a frame of reference by which the rendering function is to render the reduced plurality of hierarchical elements based on the transformation information, and combine the transformed rendering function with a complex binaural room impulse response function using multiplication operations.

16. The device of claim 11, wherein to perform the binaural audio rendering, the one or more processors are further configured to transform a rendering function by transforming a frame of reference by which the rendering function is to render the reduced plurality of hierarchical elements based on the transformation information, and combine the transformed rendering function with a complex binaural room impulse response function using multiplication operations and without requiring convolution operations.

17. The device of claim 11, wherein to perform the binaural audio rendering, the one or more processors are further configured to transform a rendering function by transforming a frame of reference by which the rendering function is to render the reduced plurality of hierarchical elements based on the transformation information, combine the transformed rendering function with a complex binaural room impulse response function to generate a rotated binaural audio rendering function, and apply the rotated binaural audio rendering function to the reduced plurality of hierarchical elements to generate left and right channels.

18. The device of claim 11, the plurality of hierarchical elements comprising a plurality of spherical harmonic coefficients of which at least one of the plurality of spherical harmonic coefficients is associated with an order greater than one.

19. The device of claim 11, the one or more processors further configured to:

parse the encoded audio data from the bitstream;

decode the parsed encoded audio data to generate the reduced plurality of hierarchical elements; and parse the transformation information from the bitstream.

20. The device of claim 11, the one or more processors further configured to:

obtain a position of a head of a listener relative to the sound field represented by the plurality of hierarchical; and determine updated transformation information based on the transformation information and the position of the head of the listener, wherein to perform the binaural audio rendering the one or more processors are further configured to perform the binaural audio rendering with respect to the reduced plurality of hierarchical elements based on the updated transformation information.

21. An apparatus comprising:

means for obtaining a bitstream that includes encoded audio data and transformation information;

means for decoding the encoded audio data to obtain a reduced plurality of hierarchical elements, the transformation information describing how a sound field represented by a plurality of hierarchical elements was transformed in order to generate the reduced plurality of hierarchical elements, the reduced plurality of hierarchical elements having a number of hierarchical elements that is less than a number of the plurality of hierarchical elements; and means for performing the binaural audio rendering with respect to the reduced plurality of hierarchical elements based on the transformation information.

22. The apparatus of claim 21, wherein the means for performing the binaural audio rendering comprises means for transforming a frame of reference by which to render the reduced plurality of hierarchical elements to a plurality of channels based on the transformation information.

23. The apparatus of claim 21, the transformation information comprising rotation information that specifies at least an elevation angle and an azimuth angle by which the sound field was transformed.

24. The apparatus of claim 21, wherein the means for performing the binaural audio rendering comprises:

means for transforming a frame of reference by which a rendering function is to render the reduced plurality of hierarchical elements based on the transformation information; and means for applying an energy preservation function with respect to the transformed rendering function.

25. The apparatus of claim 21, wherein the means for performing the binaural audio rendering comprises:

means for transforming a rendering function by transforming a frame of reference by which the rendering function is to render the reduced plurality of hierarchical elements based on the transformation information; and means for combining the transformed rendering function with a complex binaural room impulse response function using multiplication operations and without requiring convolution operations.

26. The apparatus of claim 21, wherein the means for performing the binaural audio rendering comprises:

means for transforming a rendering function by transforming a frame of reference by which the rendering function is to render the reduced plurality of hierarchical elements based on the transformation information;

means for combining the transformed rendering function with a complex binaural room impulse response function to generate a rotated binaural audio rendering function; and means for applying the rotated binaural audio rendering function to the reduced plurality of hierarchical elements to generate left and right channels.

27. The apparatus of claim 21, the plurality of hierarchical elements comprising a plurality of spherical harmonic coefficients of which at least one of the plurality of spherical harmonic coefficients is associated with an order greater than one.

28. The apparatus of claim 21, further comprising:

means for parsing the encoded audio data from the bitstream to obtain parsed encoded audio data;

means for decoding the parsed encoded audio data to obtain the reduced plurality of hierarchical elements means for parsing the transformation information from the bitstream.

29. The apparatus of claim 21, further comprising:

means for obtaining a position of a head of a listener relative to the sound field represented by the plurality of hierarchical elements; and means for determining updated transformation information based on the transformation information and the position of the head of the listener, wherein the means for performing the binaural audio rendering comprises means for performing the binaural audio rendering with respect to the reduced plurality of hierarchical elements based on the updated transformation information.

30. A non-transitory computer-readable storage medium comprising instructions stored thereon that, when executed, configure one or more processors to:

obtain a bitstream that includes encoded audio data and transformation information;

decode the encoded audio data to obtain a reduced plurality of hierarchical elements, the transformation information describing how a sound field represented by a plurality of hierarchical elements was transformed in order to generate the reduced plurality of hierarchical elements, the reduced plurality of hierarchical elements having a number of hierarchical elements that is less than a number of the plurality of hierarchical elements; and perform the binaural audio rendering with respect to the reduced plurality of hierarchical elements based on the transformation information.

* * * * *